US011854494B2

(12) United States Patent
Ai et al.

(10) Patent No.: US 11,854,494 B2
(45) Date of Patent: Dec. 26, 2023

(54) VOLTAGE ADJUSTMENT METHOD AND ELECTRONIC DEVICE

(71) Applicant: HUAWEI TECHNOLOGIES CO., LTD., Guangdong (CN)

(72) Inventors: Jinqin Ai, Shenzhen (CN); Jinsong Wen, Shenzhen (CN); Yiyang Zhang, Shenzhen (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 17/550,001

(22) Filed: Dec. 14, 2021

(65) Prior Publication Data

US 2022/0101800 A1 Mar. 31, 2022

Related U.S. Application Data

(63) Continuation of application No. PCT/CN2020/095759, filed on Jun. 12, 2020.

(30) Foreign Application Priority Data

Jun. 14, 2019 (CN) ..... 201910517297.1

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2310/0289* (2013.01); *G09G 2330/028* (2013.01)

(58) Field of Classification Search
CPC ... G09G 2320/0626; G09G 2320/0271; G09G 2320/0673; G09G 2320/0666;
(Continued)

(56) References Cited

U.S. PATENT DOCUMENTS 9,666,126 B2 5/2017 Jeong et al.
2006/0262047 A1 11/2006 Hu
(Continued)

FOREIGN PATENT DOCUMENTS

CN 103177693 A 6/2013
CN 105304025 A 2/2016
(Continued)

OTHER PUBLICATIONS

European Search Report for European Application No. 20822776 dated Sep. 14, 2022, 13 pages.
(Continued)

*Primary Examiner* — Dong Hui Liang

(57) ABSTRACT

The technology of this application relates to a voltage adjustment method and an electronic device. The method includes obtaining a target luminance value of current display of a display pixel, determining a voltage increment value based on the target luminance value, and adjusting, based on the voltage increment value, an initial cathode voltage of an OLED device corresponding to the display pixel, where after voltage adjustment, a change amount between a luminance value of the display pixel and the target luminance value falls within a preset range. This application may be applied to an electronic device, and display quality of a display screen can be improved while reducing power consumption of the display screen.

17 Claims, 9 Drawing Sheets

(58) Field of Classification Search
CPC ..... G09G 2320/043; G09G 2320/0285; G09G 2330/021; G09G 2360/16; G09G 5/10; G09G 3/3426; G09G 3/3607
See application file for complete search history.

(56) References Cited

U.S. PATENT DOCUMENTS

| | | | | |
|---|---|---|---|---|
| 2011/0221784 | A1 | 9/2011 | Lee et al. | |
| 2012/0105408 | A1 | 5/2012 | Kang | |
| 2012/0293481 | A1 | 11/2012 | Chaji | |
| 2014/0104305 | A1* | 4/2014 | Ryu | G09G 3/3208 345/589 |
| 2014/0204069 | A1* | 7/2014 | Chien | G09G 3/3291 345/212 |
| 2016/0049111 | A1 | 2/2016 | Lee et al. | |
| 2017/0039949 | A1 | 2/2017 | Liu et al. | |

FOREIGN PATENT DOCUMENTS

| | | | |
|---|---|---|---|
| CN | 106803418 | A | 6/2017 |
| CN | 106847178 | A | 6/2017 |
| CN | 107169938 | A | 9/2017 |
| CN | 108154847 | A | 6/2018 |
| CN | 108172199 | A | 6/2018 |
| CN | 108766347 | A | 11/2018 |
| CN | 108806609 | A | 11/2018 |
| CN | 108877660 | A | 11/2018 |
| CN | 109036286 | A | 12/2018 |
| CN | 110111735 | A | 8/2019 |

OTHER PUBLICATIONS

Notice of Allowance dated Feb. 28, 2022 for Chinese Application No. 201910517297.1, 5 pages.
Office Action dated May 8, 2021 for Chinese Application No. 201910517297.1, 10 pages.
PCT International Search Report for PCT/CN2020/095759 dated Jun. 12, 2020, 9 pages.

* cited by examiner

VOLTAGE ADJUSTMENT METHOD AND ELECTRONIC DEVICE

CROSS-REFERENCE TO RELATED APPLICATIONS

This application is a continuation of International Application No. PCT/CN2020/095759, filed on Jun. 12, 2020, which claims priority to Chinese Patent Application No. 201910517297.1, filed on Jun. 14, 2019. The disclosures of the aforementioned applications are hereby incorporated by reference in their entireties.

TECHNICAL FIELD

This application relates to the field of display technologies, and in particular, to a voltage adjustment method and an electronic device.

BACKGROUND

With the development of the information era, mobile electronic devices such as mobile phones and tablet computers have become an indispensable part of people's life. In addition to factors such as performance and appearance, power consumption (e.g., standby time) is also an important aspect to be considered when consumers choose mobile products. For a display screen, as one of main power-consuming devices of a mobile device, the energy-saving technology thereof has become an important subject in the industry.

An active-matrix organic light-emitting diode (AMOLED), as a self-luminescent device, has advantages of fast response speed, vivid color, and bendability, and is widely used in display fields such as mobile phones, tablet computers, and televisions. FIG. 1 is a schematic diagram of a circuit in which a DTFT drives an OLED device in a pixel circuit unit. Power consumed by the OLED device is calculated as $P=(V_{ELVDD}-V_{ELVSS})\times I_D$. $V_{ELVSS}$ is a cathode voltage output by a power supply management unit to an organic light-emitting diode (OLED) device, and $V_{ELVDD}$ is a source voltage output by the power supply management unit to the DTFT.

However, the conventional circuit has a disadvantage of high power consumption, and the power consumption of the OLED device needs to be further reduced.

SUMMARY

This application provides a voltage adjustment method and an electronic device.

In a first aspect, this application provides a voltage adjustment method, including: obtaining a target luminance value of current display of a display pixel; determining a voltage increment value based on the target luminance value; and adjusting, based on the voltage increment value, an initial cathode voltage of an OLED device corresponding to the display pixel, where after voltage adjustment, a change amount between a luminance value of the display pixel and the target luminance value falls within a preset range.

In an optional implementation of the first aspect, the determining a voltage increment value based on the target luminance value includes:

determining, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

In an optional implementation of the first aspect, the determining a voltage increment value based on the target luminance value includes:

determining, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

In an optional implementation of the first aspect, the preset range is less than or equal to 5% of the target luminance value.

In an optional implementation of the first aspect, after voltage adjustment, a drive transistor of an OLED corresponding to the display pixel operates in a constant current range.

In an optional implementation of the first aspect, after voltage adjustment, voltage redundancy is left between a source-drain voltage of the drive transistor of the OLED corresponding to the display pixel and a variable resistance range.

In a second aspect, this application provides a voltage adjustment method, including: obtaining a target luminance value of current display of a target display area; determining a voltage increment value based on the target luminance value; and adjusting, based on the voltage increment value, an initial cathode voltage of an OLED device included in the target display area, where after voltage adjustment, a change amount between a luminance value of the target display area and the target luminance value falls within a preset range.

In an optional implementation of the second aspect, the determining a voltage increment value based on the target luminance value includes:

determining, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

In an optional implementation of the second aspect, the determining a voltage increment value based on the target luminance value includes:

determining, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

In an optional implementation of the second aspect, the preset range is less than or equal to 5% of the target luminance value.

In an optional implementation of the second aspect, the obtaining a target luminance value of current display of a target display area includes: obtaining at least one grayscale value of current display of the target display area, where the at least one grayscale value includes: a first grayscale value, a second grayscale value, or a third grayscale value; where the first grayscale value is used to represent an average grayscale value of a plurality of display pixels included in the target display area; in the target display area, a quantity of display pixels with grayscale values greater than or equal to the second grayscale value is greater than or equal to a preset quantity, and a quantity of display pixels with grayscale values greater than or equal to a fourth grayscale value is less than a first preset value, and the fourth grayscale value is any grayscale value greater than the second grayscale value; and the third grayscale value corresponds to saturation and hue of the target display area; and determining a weighted average value of the at least one grayscale value as the target luminance value of current display of the target display area.

In an optional implementation of the second aspect, the target display area includes a plurality of display pixels. Each display pixel in the plurality of display pixels corresponds to one RGB vector. The RGB vector includes an R value, a G value, and a B value.

The obtaining at least one grayscale value of current display of the target display area includes: obtaining a plurality of first sub-grayscale values of current display of the target display area, where each display pixel in the plurality of display pixels corresponds to one first sub-grayscale value, and the first sub-grayscale value is a weighted average value of a corresponding R value, G value, and B value; and determining a weighted average value of the plurality of first sub-grayscale values as the first grayscale value.

In an optional implementation of the second aspect, the target display area includes a plurality of display pixels. Each display pixel in the plurality of display pixels corresponds to one RGB vector. The RGB vector includes an R value, a G value, and a B value.

The obtaining at least one grayscale value of current display of the target display area includes: obtaining a plurality of second sub-grayscale values of current display of the target display area, where each display pixel in the plurality of display pixels corresponds to one second sub-grayscale value, and the second sub-grayscale value is a maximum value of a corresponding R value, G value, and B value, or the second sub-grayscale value is the corresponding R value, or the second sub-grayscale value is the corresponding G value, or the second sub-grayscale value is the corresponding B value, or the second sub-grayscale value is a larger one of the corresponding R value and G value, or the second sub-grayscale value is a larger one of the corresponding R value and B value, or the second sub-grayscale value is a larger one of the corresponding G value and B value; and determining, based on the plurality of second sub-grayscale values, the second grayscale value of current display of the target display area, where a quantity of second sub-grayscale values greater than or equal to the second grayscale value in the plurality of second sub-grayscale values is greater than or equal to a preset quantity, a quantity of second sub-grayscale values greater than or equal to a fourth grayscale value in the plurality of second sub-grayscale values is less than the preset quantity, and the fourth grayscale value is any grayscale value greater than the second grayscale value.

In an optional implementation of the second aspect, the target display area includes a plurality of display pixels, and each display pixel in the plurality of display pixels corresponds to one saturation value and one hue value.

The obtaining at least one grayscale value of current display of the target display area includes: obtaining a plurality of saturation values and a plurality of hue values of current display of the target display area; determining an average value of the plurality of saturation values as a target saturation average value; determining an average value of the plurality of hue values as a target hue average value; and determining, based on a third preset relationship, a third grayscale value corresponding to the target saturation average value and the target hue average value, where the third preset relationship includes a correspondence among a plurality of saturation average values, a plurality of hue average values, and a plurality of third grayscale values, the target saturation average value is one of the plurality of saturation average values, and the target hue average value is one of the plurality of hue average values.

In an optional implementation of the second aspect, after voltage adjustment, a drive transistor of an OLED included in the target display area operates in a constant current range.

In an optional implementation of the second aspect, after voltage adjustment, voltage redundancy is left between a source-drain voltage of the drive transistor of the OLED included in the target display area and a variable resistance range.

In a third aspect, this application provides a voltage adjustment method, where the method is applied to an electronic device, a display screen of the electronic device includes at least a first display area and a second display area, the first display area includes a first boundary area, the second display area includes a second boundary area, the first boundary area is adjacent to the second boundary area, and the method includes: obtaining a first target luminance value of current display of the first display area; obtaining a second target luminance value of current display of the second display area; determining a first voltage increment value based on the first target luminance value; determining a second voltage increment value based on the second target luminance value; adjusting, based on the first voltage increment value, an initial cathode voltage of an OLED device included in the first display area, where after voltage adjustment, a change amount between a luminance value of the first display area and the first target luminance value falls within a preset range; and adjusting, based on the first voltage increment value, an initial cathode voltage of an OLED device included in the first display area, where after voltage adjustment, a change amount between a luminance value of the first display area and the first target luminance value falls within a preset range; and if an absolute value of a difference between the first voltage increment value and the second voltage increment value is greater than a preset difference, separately performing pixel smoothing processing on the first boundary area and the second boundary area.

In an optional implementation of the third aspect, the determining a first voltage increment value based on the first target luminance value and the determining a second voltage increment value based on the second target luminance value include: determining, based on a first preset relationship, the first voltage increment value corresponding to the first target luminance value; and determining, based on the first preset relationship, the second voltage increment value corresponding to the second target luminance value.

The first preset relationship includes a correspondence between a plurality of luminance values and a plurality of voltage increment values, where the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values.

In an optional implementation of the third aspect, the determining a first voltage increment value based on the first target luminance value and the determining a second voltage increment value based on the second target luminance value include: determining, based on a second preset relationship, the first voltage increment value corresponding to the first target luminance value; and determining, based on the second preset relationship, the second voltage increment value corresponding to the second target luminance value.

The second preset relationship includes a correspondence between a plurality of luminance values and a plurality of voltage increment values, where a voltage value in the plurality of voltage increment values decreases as the luminance value increases, the first target luminance value is one of the plurality of luminance values, and the second target luminance value is one of the plurality of voltage increment values.

In an optional implementation of the third aspect, the preset range is less than or equal to 5% of the target luminance value.

In an optional implementation of the third aspect, after voltage adjustment, drive transistors of OLEDs included in the first display area and the second display area operate in a constant current range.

In an optional implementation of the third aspect, after voltage adjustment, voltage redundancy is left between a variable resistance range and respective source-drain voltages of drive transistors of OLEDs included in the first display area and the second display area.

In a fourth aspect, this application provides an electronic device, including: one or more processors, configured to obtain a target luminance value of current display of a display pixel; and determine a voltage increment value based on the target luminance value; and a power supply management circuit, configured to adjust, based on the voltage increment value, an initial cathode voltage of an OLED device corresponding to the display pixel, where after voltage adjustment, a change amount between a luminance value of the display pixel and the target luminance value falls within a preset range.

In an optional implementation of the fourth aspect, the processor is specifically configured to:

determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

In an optional implementation of the fourth aspect, the processor is configured to:

determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

In an optional implementation of the fourth aspect, the preset range is less than or equal to 5% of the target luminance value.

In a fifth aspect, this application provides an electronic device, including: one or more processors, configured to obtain a target luminance value of current display of a target display area; and determine a voltage increment value based on the target luminance value; and a power supply management circuit, configured to adjust, based on the voltage increment value, an initial cathode voltage of an OLED device included in the target display area, where after voltage adjustment, a change amount between a luminance value of the target display area and the target luminance value falls within a preset range.

In an optional implementation of the fifth aspect, the processor is configured to:

determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

In an optional implementation of the fifth aspect, the processor is configured to:

determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

In an optional implementation of the fifth aspect, the preset range is less than or equal to 5% of the target luminance value.

In a sixth aspect, this application provides a voltage adjustment method, where the method is applied to an electronic device, a display screen of the electronic device includes at least a first display area and a second display area, the first display area includes a first boundary area, the second display area includes a second boundary area, the first boundary area is adjacent to the second boundary area, and the method includes: obtaining a first target luminance value of current display of the first display area; obtaining a second target luminance value of current display of the second display area; determining a first voltage increment value based on the first target luminance value; determining a second voltage increment value based on the second target luminance value; adjusting, based on the first voltage increment value, an initial cathode voltage of an OLED device included in the first display area, where after voltage adjustment, a change amount between a luminance value of the first display area and the first target luminance value falls within a preset range; and adjusting, based on the first voltage increment value, an initial cathode voltage of an OLED device included in the first display area, where after voltage adjustment, a change amount between a luminance value of the first display area and the first target luminance value falls within a preset range; and if an absolute value of a difference between the first voltage increment value and the second voltage increment value is greater than a preset difference, separately performing pixel smoothing processing on the first boundary area and the second boundary area.

In an optional implementation of the sixth aspect, the method further includes: determining, based on a first preset relationship, the first voltage increment value corresponding to the first target luminance value; and determining, based on the first preset relationship, the second voltage increment value corresponding to the second target luminance value.

The first preset relationship includes a correspondence between a plurality of luminance values and a plurality of voltage increment values, where the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values.

In an optional implementation of the sixth aspect, the method further includes: determining, based on a second preset relationship, the first voltage increment value corresponding to the first target luminance value; and determining, based on the second preset relationship, the second voltage increment value corresponding to the second target luminance value.

The second preset relationship includes a correspondence between a plurality of luminance values and a plurality of voltage increment values, where a voltage value in the plurality of voltage increment values decreases as the luminance value increases, the first target luminance value is one of the plurality of luminance values, and the second target luminance value is one of the plurality of voltage increment values.

In an optional implementation of the sixth aspect, the preset range is less than or equal to 5% of the target luminance value.

In a seventh aspect, this application provides a voltage adjustment device, including: an obtaining module, configured to obtain a target luminance value of current display of a display pixel; a processing module, configured to determine a voltage increment value based on the target luminance value; and a voltage adjustment module, configured to adjust, based on the voltage increment value, an initial cathode voltage of an OLED device corresponding to the display pixel, where after voltage adjustment, a change amount between a luminance value of the display pixel and the target luminance value falls within a preset range.

In an eighth aspect, this application provides a voltage adjustment device, including: an obtaining module, configured to obtain a target luminance value of current display of a target display area; a processing module, configured to determine a voltage increment value based on the target luminance value; and a voltage adjustment module, configured to adjust, based on the voltage increment value, an initial cathode voltage of an OLED device included in the target display area, where after voltage adjustment, a change amount between a luminance value of the target display area and the target luminance value falls within a preset range.

In a ninth aspect, this application provides a computer storage medium, including computer instructions, where the computer instructions, when run on an electronic device, cause the electronic device to perform the voltage adjustment method according to the first aspect.

In a tenth aspect, this application provides a computer storage medium, including computer instructions, where the computer instructions, when run on an electronic device, cause the electronic device to perform the voltage adjustment method according to the second aspect.

In an eleventh aspect, this application provides a computer storage medium, including computer instructions, where the computer instructions, when run on an electronic device, cause the electronic device to perform the voltage adjustment method according to the third aspect.

Embodiments of this application provide a voltage adjustment method, including: obtaining a target luminance value of current display of a display pixel; determining a voltage increment value based on the target luminance value; adjusting, based on the voltage increment value, an initial cathode voltage of an OLED device corresponding to the display pixel, where after voltage adjustment, a change amount between a luminance value of the display pixel and the target luminance value falls within a preset range. In the foregoing manner, on the one hand, display power consumption of an electronic device is reduced by increasing the cathode voltage of the OLED device corresponding to the display pixel, and on the other hand, after the cathode voltage of the OLED device is increased, the change amount of the luminance value of the display pixel falls within the preset range, so that a display luminance value corresponding to the display pixel does not change significantly, and a display effect of the display screen is improved.

DESCRIPTION OF EMBODIMENTS

Terms used in the following embodiments are merely intended to describe particular embodiments, but are not intended to limit this application. The terms "one", "a", "the", "the foregoing", "this", and "the one" of singular forms used in this specification and the appended claims of this application are also intended to include plural forms such as "one or more", unless otherwise specified in the context clearly. It should be further understood that, in the embodiments of this application, "one or more" means one, two, or more. In addition, "and/or" describes an association relationship between associated objects, and indicates that at least three relationships may exist. For example, A and/or B may indicate the following cases: Only A exists, both A and B exist, and only B exists, where A and B may be singular or plural. The character "I" usually indicates an "or" relationship between the associated objects.

Reference to "an embodiment", "some embodiments", or the like described in this specification indicates that one or more embodiments of this application include a particular feature, structure, or characteristic described with reference to the embodiments. Therefore, in this specification, statements, such as "in an embodiment", "in some embodiments", "in some other embodiments", and "in other embodiments", that appear at different places do not necessarily mean referencing a same embodiment, instead, they mean "one or more but not all of the embodiments", unless otherwise specifically emphasized in other ways. The terms "include", "have", and variants of the terms all mean "include but are not limited to", unless otherwise specifically emphasized in other ways.

In a pixel circuit unit, power consumed by an OLED device is $P=(V_{ELVDD}-V_{ELVSS})\times V_{ELVSS}$ is a cathode voltage output by a power supply management circuit to an organic light-emitting diode (OLED) device, $V_{ELVDD}$ is a source voltage output by the power supply management circuit to the drive transistor DTFT, and power consumption of the OLED device can be effectively reduced by increasing the $V_{ELVSS}$ voltage value.

Figure 7:
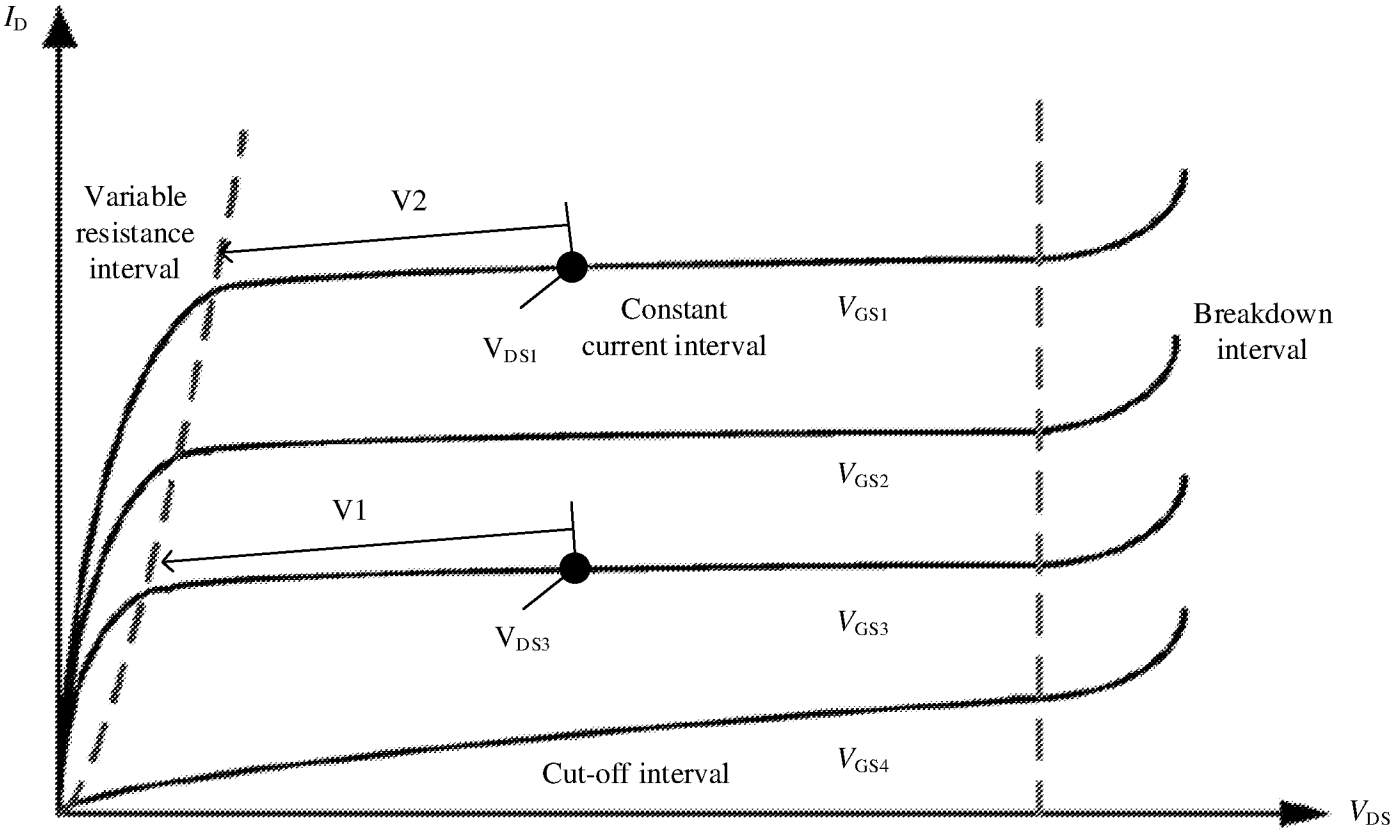
FIG. 7 is an example diagram of change curves of a drain current $I_D$ and a drain-source voltage $V_{DS}$ of a DTFT in a pixel circuit unit.

FIG. 7 is a diagram of change curves of a drain current $I_D$ and a drain-source voltage $V_{DS}$ of a drive transistor DTFT. As shown in FIG. 7, the DTFT that determines the current $I_D$ of the OLED device generally operates in a saturation range, that is, a constant current range in FIG. 7. In this case, $I_D$ approaches a stable value. When a gate-source voltage $V_{GS}$ of the DTFT is a fixed value, the value of the current $I_D$ of the OLED device is almost independent of the source-drain voltage $V_{DS}$ of the DTFT if a channel width modulation effect is not considered for the DTFT in the saturation range. In the conventional technologies, by maintaining the current $I_D$ of the organic light-emitting diode (OLED) device of the pixel circuit unit in the constant current range and increasing the cathode voltage $V_{ELVSS}$ of the OLED device of the pixel circuit unit, power is supplied to a cathode of the OLED device of the pixel circuit unit based on a maximum value of the $V_{ELVSS}$ when $I_D$ is in the constant current range. This reduces power consumption of the display screen. In this case, the current $I_D$ passing through the OLED device may be considered to remain unchanged.

However, even when the DTFT keeps operating in the saturation range state, the luminance value of the display screen may change, thereby affecting the display effect of the display screen. In other words, the current $I_D$ passing through the OLED device is not completely positively correlated with the luminance value of the display screen.

Based on this, an embodiment of this application provides a voltage adjustment method, which may be applied to an electronic device. By determining a voltage increment value of a corresponding cathode voltage of an OLED device based on a luminance value of current display of a display pixel and increasing the cathode voltage of the corresponding OLED device under a condition that a change amount of the luminance value displayed by the display pixel falls within a preset range, so that display luminance of the display screen does not change significantly, and display quality of the display screen is improved while reducing power consumption of the display screen.

The voltage adjustment method provided in this embodiment of this application may be applied to an electronic device such as a mobile phone, a tablet computer, a wearable device, a vehicle-mounted device, and an augmented reality (AR)/virtual reality (VR) device, a notebook computer, an ultra-mobile personal computer (UMPC), a netbook, or a personal digital assistant (PDA), and a specific type of the electronic device is not limited in this embodiment of this application.

Figure 1:
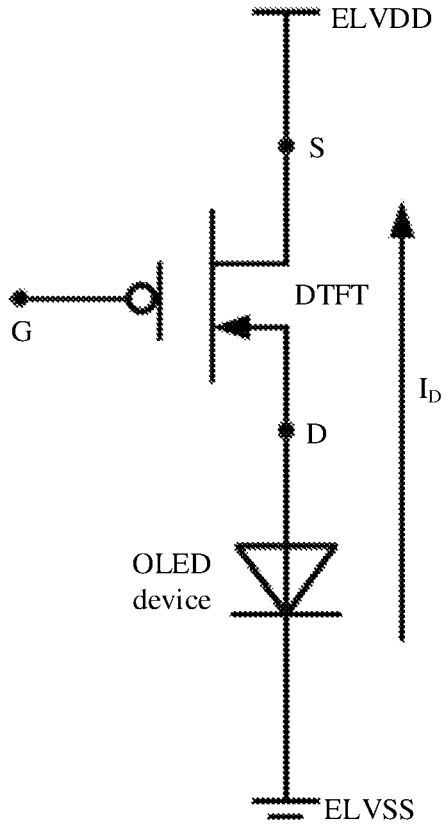
FIG. 1 is an example schematic diagram of a circuit in which a DTFT drives an OLED device in a pixel circuit unit.
Figure 2A:
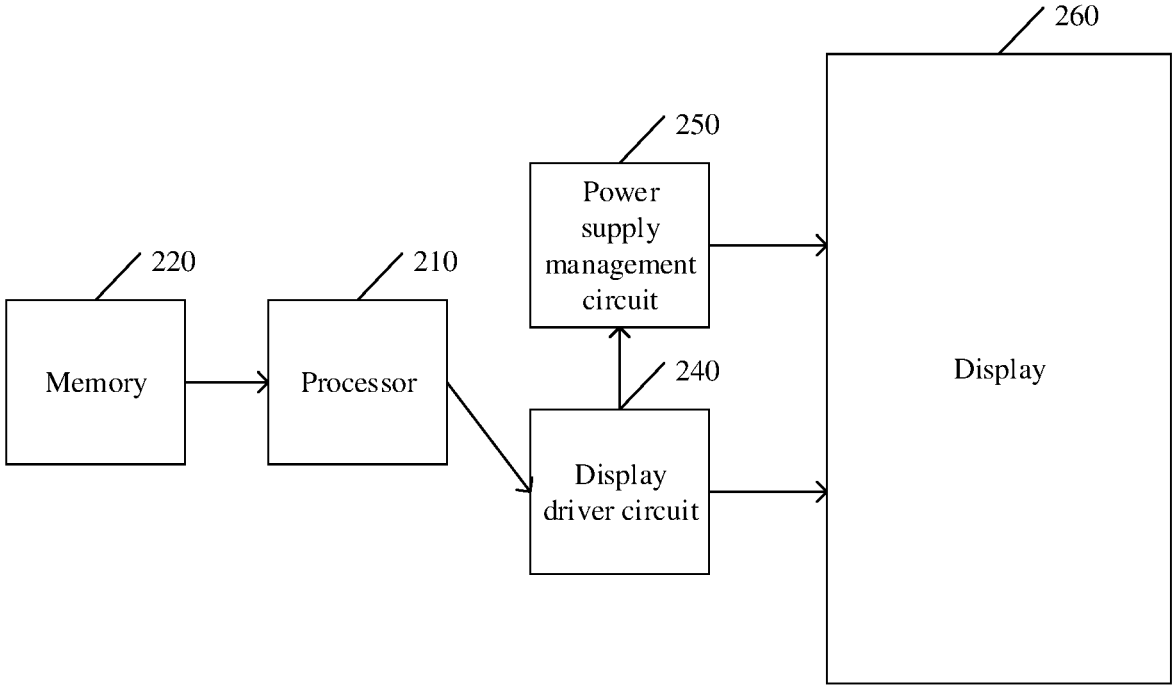
FIG. 2*a* is an example schematic diagram of a structure of an electronic device according to an embodiment of this application.

FIG. 2*a* is a schematic diagram of a structure of an electronic device according to an embodiment of the present technology. It may be understood that, the structures shown in the embodiments of this application do not constitute specific limitation to the electronic device 200. In some other embodiments of this application, the electronic device 200 may include more or fewer components than those shown in the figure, or some components may be combined, or some components may be split, or different component arrangements may be used. The components shown in the figure may be implemented by hardware, software, or a combination of software and hardware.

As shown in FIG. 2*a*, the electronic device 200 may include a processor 210, a memory 220, a display driver circuit 240, a power supply management circuit 250, and a display screen 260.

The processor 210 may include one or more processors. For example, the processor 210 may include one or more central processing units (CPU), or include one central processing unit and one graphics processing unit. When the processor 210 includes a plurality of processors, the plurality of processors may be integrated in a same chip, or may be chips separate from each other. For example, the processor 210 may include an application processor (AP), a modem processor, a graphics processing unit (GPU), an image signal processor (ISP), a controller, a video codec, a digital signal processor (DSP), a baseband processor, and/or a neural-network processing unit (NPU). Different processing units may be separate devices, or may be integrated into one or more processors.

The graphics processing unit is responsible for conventional image processing and may be contained in a single chip or may exist independently.

The memory 220 may be one or more of the following: a flash memory, a hard disk type memory, a micro multimedia card type memory, a card type memory (for example, an SD or XD memory), a random access memory (RAM), a static random access memory (SRAM), a read-only memory (ROM), an electrically erasable programmable read-only memory (EEPROM), a programmable read-only memory (PROM), or a magnetic memory.

The memory 220 may be configured to store one or more computer programs, and the one or more computer programs include instructions. The processor 210 may run the foregoing instructions stored in the memory 220, so that the electronic device 200 performs the voltage adjustment method, various functional applications, data processing, and the like provided in some embodiments of this application.

In this embodiment of this application, the processor 210 may run the foregoing instructions stored in the memory 220, so that the processor 210 performs operations of obtaining a target luminance value of current display of a display pixel, determining a voltage increment value based on the target luminance value, and sending digital information carrying the voltage increment value to a display driver circuit (display driver IC, DDIC) 240.

The display driver circuit 240 may forward the digital information received from the processor 210 to the power supply management circuit 250, perform digital-to-analog conversion on the digital information received from the processor 210, and send the information to the display screen 260 for display. In addition, the DDIC 240 may also perform pixel smoothing processing (for example, average value filtering) on a display pixel in the display screen.

The power supply management circuit 250 performs digital-to-analog conversion on the digital information received from the DDIC 240, and outputs analog information to screen hardware for validation, so that a cathode voltage of an OLED device corresponding to the display pixel is increased by a corresponding voltage increment value based on an initial cathode voltage.

The display screen 260 displays an image based on the received information, where the display screen 260 may be specifically an AMOLED display. The display screen 260 is configured to display an image, a video, and the like. The display screen 260 includes a display panel. The display panel may be an organic light-emitting diode (OLED), an active-matrix organic light-emitting diode (AMOLED), or the like.

In some embodiments, the electronic device 100 may include one or N display screens 260. N is a positive integer greater than 1.

Figure 2B:
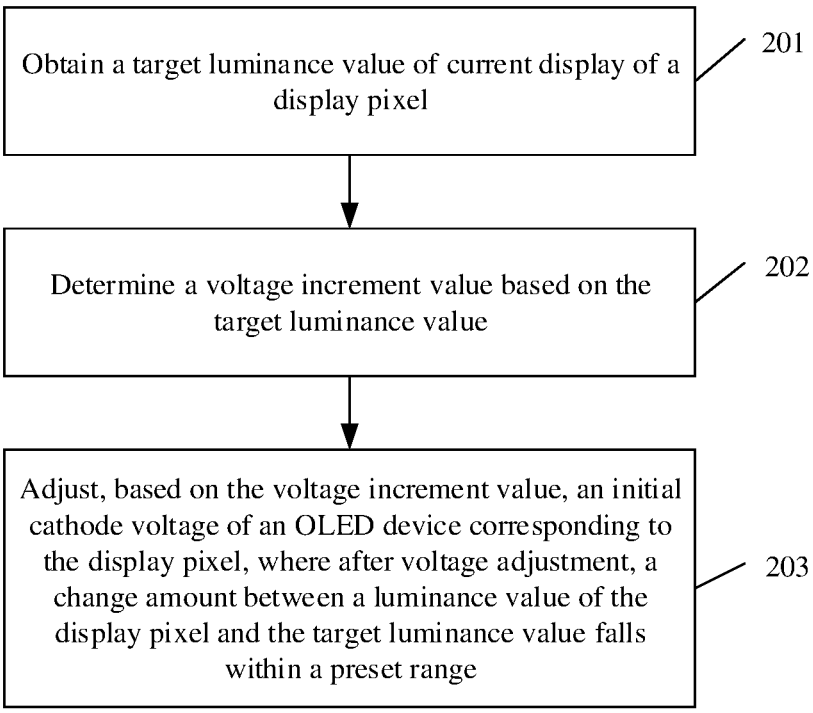
FIG. 2*b* is an example schematic flowchart of a voltage adjustment method according to an embodiment of this application.

FIG. 2*b* is a schematic flowchart of a voltage adjustment method according to an embodiment of this application. As shown in FIG. 2*b*, the voltage adjustment method provided in this embodiment of this application may include:

201. Obtain a target luminance value of current display of a display pixel.

In this embodiment of this application, a processor may obtain the target luminance value of current display of the display pixel, and the target luminance value may be used to quantize luminance of current display of the display pixel.

Optionally, in an embodiment, a target display luminance value may be quantized based on an RGB vector. Specifically, the RGB vector may include an R value, a G value, and a B value.

In an embodiment, the processor may obtain at least one grayscale value of current display of the display pixel, and use a weighted average value of the at least one grayscale value as the target luminance value of the display pixel, where different grayscale values may represent luminance values in different dimensions.

Specifically, in a dimension of a luminance value, the grayscale value may be correlated with an RGB vector corresponding to the display pixel.

For example, the grayscale value may be a weighted average value of the corresponding R value, G value, and B value. For example, a weight value corresponding to the R value is 0.299, a weight value corresponding to the G value is 0.587, and a weight value corresponding to the B value is 0.114. Then, the grayscale value may be calculated based on the following formula:

$$Y1=0.299R+0.587G+0.114B.$$

Y1 represents a first grayscale value, R represents an R value, G represents a G value, and B represents a B value.

If an RGB vector of a display pixel is (220, 210, 125), that is, an R value is 220, a G value is 210, and a B value is 125, a first sub-grayscale value corresponding to the display pixel is Y1=0.299*220+0.587*210+0.114*125=203.3.

It should be noted that, when the processor calculates the grayscale value, the weight values corresponding to the R value, the G value, and the B value may be selected based on an actual requirement. For example, if it is considered that red color has high impact on luminance in the current display screen, the weight corresponding to the R value may be set to be a larger value, and this is not limited in this application.

For another example, the grayscale value may be a maximum value of the corresponding R value, G value, and B value, or the grayscale value may be a larger value of the corresponding R value and G value, or the grayscale value may be a larger value of the corresponding R value and B value, or the grayscale value may be a larger value of the corresponding G value and B value.

For another example, the grayscale value may correspond to a saturation value and a hue value of the display pixel. In an embodiment, the grayscale value corresponding to the saturation value and the hue value may be determined based on a third preset relationship, where the third preset relationship includes a correspondence among a plurality of saturation values, a plurality of hue values, and a plurality of grayscale values.

In this embodiment of this application, a mapping table may be preset. The mapping table includes a correspondence among a plurality of saturation values, a plurality of hue values, and a plurality of grayscale values. In the mapping table, a higher saturation value indicates a higher hue value, and a higher corresponding grayscale value.

For example, if a display pixel has a saturation value S=0.1 and a hue value H=210, the preset mapping table may be traversed to obtain a grayscale value corresponding to the saturation value S=0.1 and the hue value H=210.

In this embodiment of this application, after obtaining the at least one grayscale value of current display of the display pixel, the processor may use a weighted average value of the at least one grayscale value as the target luminance value of the display pixel.

202. Determine a voltage increment value based on the target luminance value.

In this embodiment of this application, after obtaining the target luminance value of current display of the display pixel, the processor may determine the voltage increment value based on the target luminance value.

Optionally, in an embodiment, the processor may determine, based on a first preset relationship, the voltage increment value corresponding to the target luminance value, where the first preset relationship includes a correspondence between a plurality of luminance values and a plurality of voltage increment values, the target luminance value is one of the plurality of luminance values, and the voltage increment value corresponding to the target luminance value is one of plurality of voltage increment values.

In this embodiment of this application, a memory may store a mapping table, and the mapping table includes a correspondence between a plurality of luminance values and a plurality of voltage increment values. After obtaining the target luminance value, the processor may invoke the mapping table stored in the memory and determine a voltage increment value corresponding to the target luminance value in the mapping table.

Optionally, the processor may traverse the mapping table, and determine the voltage increment value corresponding to the target luminance value from the mapping table.

Optionally, the processor may not traverse the mapping table, but query the target luminance value from the mapping table, and determine the voltage increment value corresponding to the target luminance value from the mapping table.

In this embodiment of this application, when the mapping table is set, refer to the following manner:

On the basis that current display luminance of the display pixel is the target luminance value, when it is ensured that a change amount of a luminance value of the display pixel falls within a preset range, a maximum voltage increment value by which a cathode voltage of an OLED device corresponding to the display pixel can increase is selected. In this case, the voltage increment value is the voltage increment value corresponding to the target luminance value.

When the mapping table is set, alternatively refer to the following manner:

On the basis that current display luminance of the display pixel is the target luminance value, when it is ensured that a change amount of a luminance value of the display pixel falls within a preset range, a voltage increment value by which a cathode voltage of an OLED device corresponding to the display pixel can increase based on an initial cathode voltage is selected. In addition, to ensure that a drive transistor DTFT does not operate in a variable resistance range, after the cathode voltage of the OLED device increases by the voltage increment value, $V_{DS}$ may still have voltage redundancy with the variable resistance range. In this case, the voltage increment value is the voltage increment value corresponding to the target luminance value.

When the mapping table is set, alternatively refer to the following manner:

On the basis that current display luminance of the display pixel is the target luminance value, when it is ensured that a change amount of a luminance value of the display pixel falls within a preset range, a voltage increment value by which a cathode voltage of an OLED device corresponding to the display pixel can increase based on an initial cathode voltage is selected. For example, a luminance value range corresponds to a voltage increment value.

In an embodiment, the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, and a voltage increment value corresponding to the first luminance value is greater than a voltage increment value corresponding to the second luminance value.

That is, the first preset relationship may be a correspondence between a plurality of luminance value ranges and a plurality of voltage increment values, each voltage value range corresponds to one voltage increment value, and as a luminance value included in a luminance value range increases, a corresponding voltage increment value decreases. For example, the first luminance value range is [a, b], the second luminance value range is [c, d], and b is less than c. In this case, a luminance value included in the first luminance value range is less than a luminance value included in the second luminance value. Then, a voltage increment value corresponding to the luminance value included in the first luminance range is greater than a voltage increment value corresponding to the luminance value included in the second luminance range.

In another embodiment, the processor may determine, based on a second preset relationship, the voltage increment value corresponding to the target luminance value, where the second preset relationship includes a correspondence between a plurality of luminance values and a plurality of voltage increment values, and a voltage value in the plurality of voltage increment values decreases as the luminance value increases.

Optionally, in this embodiment of this application, the memory may store a preset function relationship, an independent variable of the preset function relationship is a target luminance value, and a dependency variable is a voltage increment value. After obtaining the target luminance value, the processor may invoke the preset function relationship from the memory, and determine a voltage increment value corresponding to the target luminance value.

203. Adjust, based on the voltage increment value, an initial cathode voltage of an OLED device corresponding to the display pixel, where after voltage adjustment, a change amount between a luminance value of the display pixel and the target luminance value falls within a preset range.

In this embodiment of this application, after determining the voltage increment value, the processor may send digital information carrying the voltage increment value to a display driver circuit (DDIC), and the DDIC may forward the digital information received from the processor to a power supply management circuit. The power supply management circuit performs digital-to-analog conversion on the information received from the DDIC, and outputs the information to screen hardware for validation, so that the cathode voltage of the OLED device corresponding to the display pixel is increased by the voltage increment value based on the initial cathode voltage.

Optionally, in an embodiment, one display pixel may correspond to one R value, one G value, and one B value, where the R value corresponds to one OLED device, the G value corresponds to one OLED device, and the B value corresponds to one OLED device. That is, one display pixel may correspond to three OLED devices. In this case, the power supply management circuit may increase cathode voltages of the three OLED devices corresponding to the display pixel by corresponding voltage increment values based on initial cathode voltages.

It should be noted that, in some scenarios, the R value may correspond to a plurality of OLED devices, the G value may correspond to a plurality of OLED devices, the B value may correspond to a plurality of OLED devices, and this is not limited in this application.

The initial cathode voltage in this embodiment of this application may be set based on requirements.

Optionally, the initial cathode voltage may be a default operating voltage provided by the power supply management circuit for the cathode of the OLED device.

Optionally, in some embodiments, the initial cathode voltage is a constant voltage value that does not vary with time and does not vary with adjustment of the luminance value of the display pixel.

Optionally, in some embodiments, the power supply management circuit may set different initial cathode voltages based on different operating conditions.

For example, the initial cathode voltage may be −2.2 V.

At a moment, the processor obtains that a target luminance value of a display pixel is 150, and the processor determines, by traversing the mapping table, that a corresponding voltage increment value is 0.4 V. Then, the power supply management circuit adjusts a cathode voltage of an OLED device corresponding to the display pixel to (−2.2 V+0.4 V). That is, the cathode voltage of the OLED device corresponding to the display pixel is adjusted to −1.8 V.

At another moment, a target luminance value of a display pixel is 250, and the processor determines, by traversing the mapping table, that a corresponding voltage increment value is 0.2 V. Then, the power supply management circuit adjusts a cathode voltage of an OLED device corresponding to the display pixel to (−2.2 V+0.2 V). That is, the cathode voltage of the OLED device corresponding to the display pixel is adjusted to −2 V.

In this embodiment of this application, after the cathode voltage of the OLED device corresponding to the display pixel is increased by the corresponding voltage increment value based on the initial cathode voltage, the change amount between the luminance value of the corresponding display pixel and the target luminance value falls within the preset range, where the preset range may be determined based on an actual requirement, provided that luminance seen by a human eye does not change significantly. This is not limited herein.

Optionally, in an embodiment, the preset range is less than or equal to 5% of the target luminance value.

For example, the adjusted luminance value of the display pixel is 240, and the target luminance value before adjustment is 230. In this case, the change amount between the adjusted luminance value of the display pixel and the target luminance value is 10. In addition, 5% of the target luminance value is 11.5. The change amount 10 is less than 11.5.

That is, in this embodiment, the preset range may be a preset function value, and the function value may vary with the target luminance value.

It should be noted that, in this embodiment of this application, a quantization manner of the change amount of the luminance value of the display pixel may be understood as being equivalent to or similar to that of the foregoing obtained target luminance value of the display pixel. For example, the change amount between the luminance value of the display pixel and the target luminance value may be a change amount between weighted average values of the at least one grayscale value corresponding to the display pixel before and after adjustment of the cathode voltage of the OLED.

An embodiment of this application provides a voltage adjustment method, including: obtaining a target luminance value of current display of a display pixel; determining a voltage increment value based on the target luminance value; adjusting, based on the voltage increment value, an initial cathode voltage of an OLED device corresponding to the display pixel, where after voltage adjustment, a change amount between a luminance value of the display pixel and the target luminance value falls within a preset range. In the foregoing manner, on the one hand, display power consumption of an electronic device is reduced by increasing the cathode voltage of the OLED device corresponding to the display pixel, and on the other hand, after the cathode voltage of the OLED device is increased, the change amount between the luminance value of the display pixel and the target luminance value falls within the preset range, so that a display luminance value corresponding to the display pixel does not change significantly, and a display effect of the display screen is improved.

In addition, the luminance value of the display pixel is defined by using a multi-dimensional grayscale value, so that precision of a definition of the luminance value is improved, and the luminance value displayed by the display pixel does not change significantly. This improves the display effect of the display screen.

Figure 3:
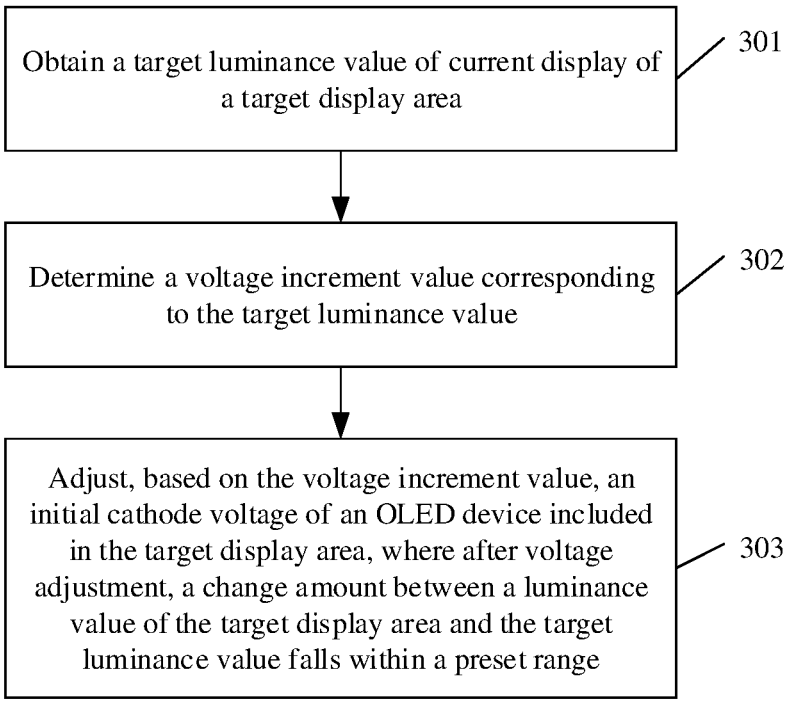
FIG. 3 is an example schematic flowchart of another voltage adjustment method according to an embodiment of this application.

FIG. 3 is a schematic flowchart of another voltage adjustment method according to an embodiment of this application. As shown in FIG. 3, the voltage adjustment method provided in this embodiment of this application may include:

301. Obtain a target luminance value of current display of a target display area.

Optionally, in a scenario, an electronic device includes one display screen, the display screen includes one target display area, and the target display area may include a plurality of display pixels.

In this embodiment of this application, a processor may obtain the target luminance value of current display of the target display area. In an embodiment, the processor may obtain at least one grayscale value corresponding to the target display area, where the at least one grayscale value may include: a first grayscale value, a second grayscale value, or a third grayscale value, and different grayscale values may represent luminance values in different dimensions. Next, the first grayscale value, the second grayscale value, and the third grayscale value are described respectively.

1. First Grayscale Value.

In this embodiment of this application, the first grayscale value may be used to represent an average grayscale value of a plurality of display pixels included in the target display area.

In this embodiment of this application, the target display area includes a plurality of display pixels. Each display pixel in the plurality of display pixels corresponds to one RGB vector. The RGB vector includes an R value, a G value, and a B value.

RGB vector: An RGB color model, also referred to as red-green-blue color model, is an additive color model. Color light of the three primary colors red, green, and blue are added in different proportions to produce a variety of color light. Currently, in computer hardware, a method in which each pixel is represented by 24 bits is adopted. Therefore, 8 bits are assigned to each of the three primary colors, and based on the highest value 28 of the 8 bits, intensity of each primary color is divided into 256 values, which is the RGB value. A value of each primary color ranges from 0 to 255 from darkest to brightest. In this embodiment of this application, the R value may be referred to as a red RGB value, the G value may be referred to as a green RGB value, and the B value may be referred to as a blue RGB value. The RGB vector is a vector including an R value, a G value, and a B value. For example, for a display pixel, if an R value is 150, a G value is 200, and a B value is 230, an RGB vector corresponding to the display pixel is (150, 200, 230).

In this embodiment of this application, the processor may obtain a plurality of first sub-grayscale values corresponding to the target display area, where each display pixel corresponds to one first sub-grayscale value, and the first sub-grayscale value is a weighted average value of a corresponding R value, G value, and B value.

For example, a weight value corresponding to the R value is 0.299, a weight value corresponding to the G value is 0.587, and a weight value corresponding to the B value is 0.114. Then, the first sub-grayscale value may be calculated based on the following formula:

$$Y1 = 0.299R + 0.587G + 0.114B.$$

Y1 represents a first grayscale value, R represents an R value, G represents a G value, and B represents a B value.

If an RGB vector of a display pixel is (220, 210, 125), that is, an R value is 220, a G value is 210, and a B value is 125, a first sub-grayscale value corresponding to the display pixel is Y1=0.299*220+0.587*210+0.114*125=203.3.

It should be noted that, when the processor calculates the first sub-grayscale value, the weight values corresponding to the R value, the G value, and the B value may be selected based on an actual requirement. For example, if it is considered that red color has high impact on luminance in the current display screen, the weight corresponding to the R value may be set to be a large value, and this is not limited in this application.

In this embodiment of this application, after obtaining the plurality of first sub-grayscale values corresponding to the target display area, the processor may determine that an average value of the plurality of first sub-grayscale values is the first grayscale value. The first grayscale value in this embodiment of this application may be used to represent an average luminance value of the target display area.

In an embodiment, because value ranges of the R value, the G value, and the B value are 0 to 255, correspondingly, a value range of the first sub-grayscale value is 0 to 255, and correspondingly, a value range of the first grayscale value is 0 to 255. A larger value of the first grayscale value indicates a brighter image displayed in the target display area.

2. Second Grayscale Value.

In this embodiment of this application, the processor may obtain a plurality of second sub-grayscale values corresponding to the target display area, where each display pixel in the plurality of display pixels corresponds to one second sub-grayscale value. Different from the above first sub-grayscale value, the R value, the G value, and the B value are not comprehensively considered in the second sub-grayscale value, but a larger value of the R value, the G value, and the B value is considered.

In an embodiment, the second sub-grayscale value may be a maximum value of a corresponding R value, G value, and B value.

For example, an RGB vector of a display pixel is (100, 150, 250). In this case, a second sub-grayscale value corresponding to the display pixel is 250.

In an embodiment, the second sub-grayscale value is the corresponding R value.

For example, an RGB vector of a display pixel is (100, 150, 250). In this case, a second sub-grayscale value corresponding to the display pixel is 100.

In an embodiment, the second sub-grayscale value is the corresponding G value.

For example, an RGB vector of a display pixel is (100, 150, 250). In this case, a second sub-grayscale value corresponding to the display pixel is 150.

In an embodiment, the second sub-grayscale value is the corresponding B value.

For example, an RGB vector of a display pixel is (100, 150, 250). In this case, a second sub-grayscale value corresponding to the display pixel is 250.

In an embodiment, the second sub-grayscale value is a larger one of the corresponding R value and G value.

For example, an RGB vector of a display pixel is (100, 150, 250). In this case, a second sub-grayscale value corresponding to the display pixel is 150.

In an embodiment, the second sub-grayscale value is a larger one of the corresponding R value and B value.

For example, an RGB vector of a display pixel is (100, 150, 250). In this case, a second sub-grayscale value corresponding to the display pixel is 250.

In an embodiment, the second sub-grayscale value is a larger one of the corresponding G value and B value.

For example, an RGB vector of a display pixel is (100, 150, 250). In this case, a second sub-grayscale value corresponding to the display pixel is 250.

It should be noted that, in actual application, a type of the second sub-grayscale value may be selected based on requirements, and this is not limited in this application.

In this embodiment of this application, after obtaining the plurality of second sub-grayscale values corresponding to the target display area, the processor may collect statistics on a quantity of the second sub-grayscale values.

Figure 4:
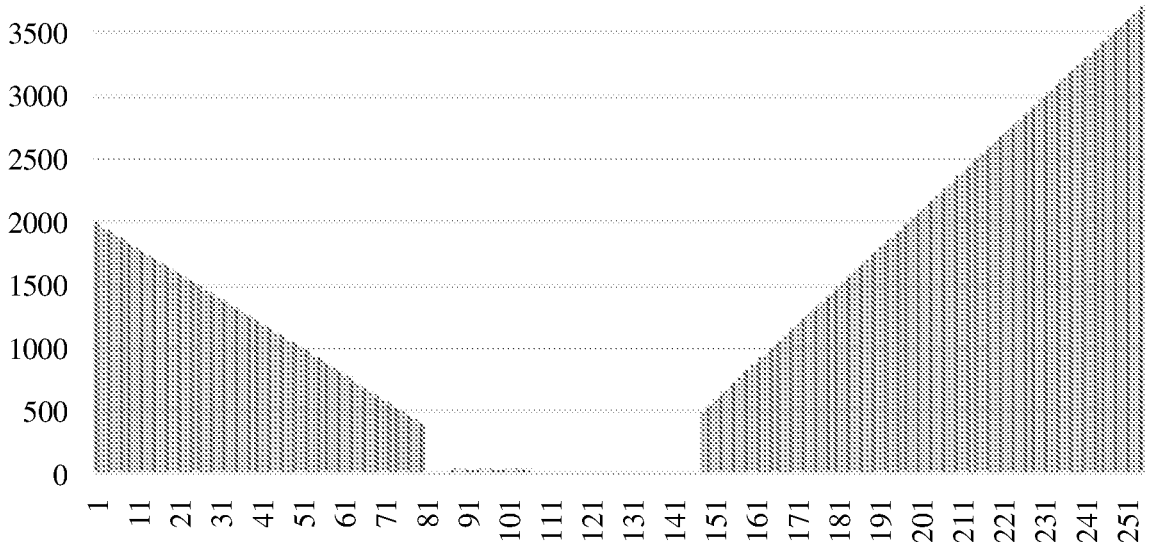
FIG. 4 is an example schematic diagram of a pixel histogram according to an embodiment of this application.

In an embodiment, the processor may obtain a pixel histogram of the target display area, and obtain the quantity of the second sub-grayscale values by using the pixel histogram. FIG. 4 is a schematic diagram of a pixel histogram according to an embodiment of this application. Specifically, the pixel histogram is a histogram representing luminance distribution. As shown in FIG. 4, a horizontal coordinate of the pixel histogram may be a second sub-grayscale value, and a vertical coordinate of the pixel histogram may be a quantity of display pixels. Therefore, the pixel histogram may describe a quantity of display pixels corresponding to each second sub-grayscale value in the target display area. In the pixel histogram, the left side of the horizontal coordinate is a pure black or dark area, and the right side is a bright or pure white area. Therefore, data in a pixel histogram of a dark picture is mostly concentrated on the left and middle parts, and data of an image that is generally bright with only a few shadows is mostly concentrated on the right part.

It should be noted that, to calculate the pixel histogram, a color space needs to be divided into several small color ranges, and each small range becomes one bin of the pixel histogram. This process is referred to as color quantization. There are many methods for color quantization, such as vector quantization, a clustering method, and a neural network method. The most common method is to evenly divide each component (e.g., dimension) of a color space, that is, equally divide an RGB range (0 to 255) into several bins, for example, the bin of the pixel histogram shown in FIG. 4 is 10. It should be noted that the pixel histogram shown in FIG. 4 is merely an example. In actual application, the pixel histogram may be set based on an actual situation, and this is not limited in this application.

In this embodiment of this application, in the target display area, a quantity of display pixels with grayscale values greater than or equal to the second grayscale value is greater than or equal to a preset quantity, and a quantity of display pixels with grayscale values greater than or equal to a fourth grayscale value is less than the preset quantity, and the fourth grayscale value is any grayscale value greater than the second grayscale value.

In this embodiment of this application, the second grayscale value may represent a second sub-grayscale value whose quantity plus a quantity of immediately larger second sub-grayscale values until a quantity of the largest second sub-grayscale values is exactly greater than the preset quantity in the pixel histogram.

For example, the preset quantity is 9000. A quantity of display pixels with a second sub-grayscale value 255 is 3710, a quantity of display pixels with a second sub-grayscale value 254 is 3680, and a quantity of display pixels with a second sub-grayscale value 253 is 3650. A sum of the quantities corresponding to the three second sub-grayscale values is 11040, which is greater than the preset quantity 9000, and the quantity of display pixels with the second sub-grayscale value 255 is 3710, which is less than the preset quantity 9000. A sum of the quantities of display pixels with the second sub-grayscale value 255 and the quantity of display pixels with the second sub-grayscale value 254 is 7390, which is less than the preset quantity 9000. Therefore, it may be determined that the second grayscale value corresponding to the target display area is 253.

3. Third Grayscale Value.

In this embodiment of this application, the third grayscale value may correspond to saturation and hue of the target display area.

In this embodiment of this application, the target display area includes a plurality of display pixels, and each display pixel in the plurality of display pixels corresponds to one saturation value and one hue value.

It should be noted that, for obtaining of the saturation value and the hue value, refer to the obtaining manner in the conventional technologies.

The processor may obtain a plurality of saturation values and a plurality of hue values that correspond to the target display area, determine an average value of the plurality of saturation values as a target saturation average value, determine an average value of the plurality of hue values as a target hue average value, and determine, based on a second preset relationship, a third grayscale value corresponding to the target saturation average value and the target hue average value, where the second preset relationship includes a correspondence among a plurality of saturation average values, a plurality of hue average values, and a plurality of third grayscale values, the target saturation average value belongs to the plurality of saturation average values, and the target hue average value belongs to the plurality of hue average values.

In this embodiment of this application, a mapping table may be preset. The mapping table includes a correspondence among a plurality of saturation average values, a plurality of hue average values, and a plurality of third grayscale values. In an embodiment, a higher saturation average value indicates a higher hue average value, and a higher corresponding third grayscale value.

For example, if the target display area has a saturation average value S_ave=0.1 and a hue average value H_ave=210, the preset mapping table may be traversed to obtain a third grayscale value corresponding to the saturation average value S_ave=0.1 and the hue average value H_ave=210.

In this embodiment of this application, after obtaining the at least one grayscale value corresponding to each target display area in at least one target display area, the processor may determine a weighted average value of the at least one grayscale value as the target luminance value corresponding to the target display area.

In an embodiment, the processor may obtain a first grayscale value corresponding to each target display area in the at least one target display area. That is, the processor may determine the first grayscale value as the target luminance value corresponding to the target display area.

In an embodiment, the processor may obtain a second grayscale value corresponding to each target display area in the at least one target display area. That is, the processor may determine the second grayscale value as the target luminance value corresponding to the target display area.

In an embodiment, the processor may obtain a third grayscale value corresponding to each target display area in the at least one target display area. That is, the processor may determine the third grayscale value as the target luminance value corresponding to the target display area.

In an embodiment, the processor may obtain a first grayscale value and a second grayscale value corresponding to each target display area in the at least one target display area. That is, the processor may determine a weighted average value of the first grayscale value and the second grayscale value as the target luminance value corresponding to the target display area.

In an embodiment, the processor may obtain a first grayscale value and a third grayscale value corresponding to each target display area in the at least one target display area. That is, the processor may determine a weighted average value of the first grayscale value and the third grayscale value as the target luminance value corresponding to the target display area.

In an embodiment, the processor may obtain a second grayscale value and a third grayscale value corresponding to each target display area in the at least one target display area. That is, the processor may determine a weighted average value of the second grayscale value and the third grayscale value as the target luminance value corresponding to the target display area.

In an embodiment, the processor may obtain a first grayscale value, a second grayscale value, and a third grayscale value corresponding to each target display area in the at least one target display area. That is, the processor may determine a weighted average value of the first grayscale value, the second grayscale value, and the third grayscale value as the target luminance value corresponding to the target display area.

For example, the processor may obtain a first grayscale value, a second grayscale value, and a third grayscale value corresponding to each target display area in the at least one target display area, where a weight corresponding to the first grayscale value is 0.3, a weight corresponding to the second grayscale value is 0.5, and a weight corresponding to the third grayscale value is 0.2. Then, the processor may determine the target luminance value corresponding to the target display area based on the following formula:

$$Y = 0.3^{*}Y1 + 0.5^{*}Y2 + 0.2^{*}Y3.$$

Y represents the target luminance value, Y1 represents the first grayscale value, Y2 represents the second grayscale value, and Y3 represents the third grayscale value.

It should be noted that, the foregoing formula is merely an example, and in actual application, the grayscale value and the corresponding weight may be selected based on an actual requirement, which is not limited herein.

302. Determine a voltage increment value corresponding to the target luminance value.

Optionally, in this embodiment of this application, after obtaining the target luminance value of current display of the target display area, the processor may determine the voltage increment value corresponding to the target luminance value.

In this embodiment of this application, the processor may determine, based on a first preset relationship, the voltage increment value corresponding to the target luminance value, where the first preset relationship includes a correspondence between a plurality of luminance values and a plurality of voltage increment values.

In this embodiment of this application, a memory may store a mapping table. After obtaining the target luminance value of current display of the target display area, the processor may invoke the mapping table stored in the memory, and determine a target voltage increment value corresponding to the target luminance value from the mapping table.

In this embodiment of this application, when the mapping table is set, refer to the following manner:

On the basis that the current display luminance of the target display area is the target luminance value, after a cathode voltage of an OLED device included in the target display area is adjusted, a change amount of a luminance value of the target display area falls within a preset range compared with that before voltage adjustment.

Refer to FIG. 7. As a cathode voltage of an OLED device becomes higher, a corresponding $V_{DS}$ becomes smaller. For example, $V_{DS}$ starts to decrease from $V_{DS1}$, and after $V_{DS}$ decreases by V2, a drive transistor DTFT enters a variable current range. An increment of a cathode voltage of the OLED device may be any value from 0 to V2.

Optionally, to ensure that the drive transistor DTFT does not operate in a variable resistance range, the increment of the cathode voltage of the OLED device may be less than V2. In this case, there is voltage redundancy between $V_{DS}$ and the variable resistance range.

Optionally, to further reduce power consumption, the increment of the cathode voltage of the OLED device may be slightly greater than V2 when it is ensured that after the cathode voltage of the OLED device included in the target display area is adjusted, compared with that before the voltage adjustment, the change amount of the luminance value of the target display area falls within the preset range.

Optionally, in an embodiment, the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, and a voltage increment value corresponding to the first luminance value is greater than a voltage increment value corresponding to the second luminance value.

FIG. 7 is a diagram of change curves of a drain current $I_D$ and a drain-source voltage $V_{DS}$ of a DTFT in a pixel circuit unit. It can be seen that, as $V_{GS}$ increases, a redundant voltage between $V_{DS}$ and the variable resistance range becomes smaller. For example, when $V_{GS}$ is $V_{GS3}$, the voltage redundancy between $V_{DS3}$ and the variable resistance range is V1; and when $V_{GS}$ is $V_{GS1}$, the voltage redundancy between $V_{DS1}$ and the variable resistance range is V2, and V2 is less than V1. Because the target luminance value of the target display area increases with $V_{GS}$, on the basis that the current display luminance of the target display area is the target luminance value while it is ensured that the change amount of the luminance value of the target display area falls within the preset range, a maximum voltage increment value by which the cathode voltage of the OLED device included in the target display area can increase based on the initial cathode voltage decreases as the target luminance value increases.

In an embodiment, to reduce power consumption of a display screen to the minimum, in the first preset relationship, a voltage increment value corresponding to each target luminance value may be set to a maximum value that can be set. In this case, the voltage increment value and the target luminance value have a strict negative correlation relationship.

In another embodiment, the voltage increment value in the plurality of voltage increment values does not strictly increase as the luminance value increases. For example, the first preset relationship may include a correspondence between a plurality of luminance value ranges and a plurality of voltage increment values, and the voltage increment value decreases as a luminance value included in the luminance value ranges increases.

In this case, voltage increment values corresponding to luminance values included in each luminance value range are the same, voltage increment values corresponding to luminance values included in different luminance value ranges are different, and the voltage increment value decreases as a luminance value included in the luminance value range increases.

For example, if the first luminance value range is [150, 180] and the second luminance value range is [210, 240], where a luminance value included in the second luminance range is greater than a luminance value included in the first luminance range, a voltage increment value corresponding to the first luminance range is 0.4, and a voltage increment value corresponding to the second luminance range is 0.2, that is, the voltage increment value corresponding to the first luminance value is greater than the voltage increment value corresponding to the second luminance value.

In this embodiment of this application, the processor may determine a luminance value range corresponding to the target luminance value, where the target luminance value belongs to the luminance value range, and determine a voltage increment value corresponding to the luminance value range as the voltage increment value corresponding to the target luminance value.

In another embodiment, the processor may determine, based on a second preset relationship, the voltage increment value corresponding to the target luminance value, where the second preset relationship includes a correspondence between a plurality of luminance values and a plurality of voltage increment values, and a voltage value in the plurality of voltage increment values decreases as the luminance value increases. Optionally, in this embodiment of this application, the memory may store a mapping table. The mapping table may include a correspondence between a plurality of target luminance values and a plurality of voltage increment values, and one target luminance value in the plurality of target luminance values corresponds to one voltage increment value in the plurality of voltage increment values.

Optionally, a voltage value in the plurality of voltage increment values decreases as the luminance value increases.

Optionally, in this embodiment of this application, the memory may store a preset function relationship, an independent variable of the preset function relationship is a target luminance value, and a dependency variable is a voltage increment value. After obtaining the target luminance value, the processor may invoke the preset function relationship from the memory, and determine a voltage increment value corresponding to the target luminance value.

Optionally, the preset function relationship is a function whose slope is a negative number.

It should be noted that, in another embodiment, the processor may determine a voltage decrement value corresponding to the target luminance value, where the voltage decrement value is less than zero, and then reducing, based on the voltage decrement value (e.g., negative value), a cathode voltage of an OLED device of a pixel circuit unit included in a corresponding target display area is equivalent to increasing, based on the voltage increment value (e.g., positive value), the cathode voltage of the OLED device of the pixel circuit unit included in the corresponding target display area.

It should be noted that, in another embodiment, the processor may determine a first voltage value corresponding to the target luminance value, where a difference between the first voltage value and the cathode voltage of the current OLED device is a target voltage increment value, and increase the cathode voltage of the OLED device of the pixel circuit unit included in the corresponding target display area based on the voltage increment value (e.g., positive value).

It should be noted that, in another embodiment, the processor may determine a second voltage value corresponding to the target luminance value, where a difference between the cathode voltage of the current OLED device and the second voltage value is a target voltage reduction value, and decreasing, based on the voltage decrement value (e.g., negative value), the cathode voltage of the OLED device of the pixel circuit unit included in the corresponding target display area is equivalent to increasing, based on the voltage increment value (e.g., positive value), the cathode voltage of the OLED device of the pixel circuit unit included in the corresponding target display area.

303. Adjust, based on the voltage increment value, an initial cathode voltage of an OLED device included in the target display area, where after voltage adjustment, a change amount between a luminance value of the target display area and the target luminance value falls within a preset range.

In this embodiment of this application, after determining the voltage increment value corresponding to the target luminance value, the processor may send the digital information carrying the voltage increment value to a display driver circuit DDIC, and the DDIC may forward the digital information received from the processor to the power supply management circuit. The power supply management circuit performs digital-to-analog conversion on the information received from the DDIC, and outputs the information to the screen hardware for validation, so that the cathode voltage of the OLED device of the pixel circuit unit included in the corresponding target display area increases by a corresponding voltage increment value from the initial cathode voltage.

That is, after the cathode voltage of the OLED device of the pixel circuit unit included in the target display area increases by a corresponding voltage increment value from the initial cathode voltage, the change amount of the luminance value of the target display area falls within a preset range, where the preset range may be determined based on an actual requirement, and this is not limited herein.

For example, the initial cathode voltage may be −2.2 V.

In some embodiments, the initial cathode voltage is a constant voltage value that does not vary with time and does not vary with adjustment of the luminance value of the display pixel.

At a moment, the processor obtains that the target luminance value of the target display area is 150, and the processor determines, by traversing the mapping table, that a corresponding voltage increment value is 0.4 V. Then, the power supply management circuit adjusts the cathode voltage of the OLED device included in the target display area to (−2.2 V+0.4 V). That is, in this case, the cathode voltage of the OLED device included in the target display area is adjusted to −1.8 V.

At another moment, the target luminance value of the target display area is 250, and the processor determines, by traversing the mapping table, that a corresponding voltage increment value is 0.2 V. Then, the power supply management circuit adjusts the cathode voltage of the OLED device included in the target display area to (−2.2 V+0.2 V). That is, in this case, the cathode voltage of the OLED device corresponding to the target display area is adjusted to −2 V.

The voltage adjustment method provided in this embodiment of this application includes: obtaining a target luminance value of current display of a target display area; determining a voltage increment value based on the target luminance value; and adjusting, based on the voltage increment value, an initial cathode voltage of an OLED device included in the target display area, where after voltage adjustment, a change amount between a luminance value of the target display area and the target luminance value falls within a preset range. In the foregoing manner, on the one hand, display power consumption of the electronic device is reduced by increasing the cathode voltage of the OLED device included in the target display area, and on the other hand, because the change amount of the luminance value of the target display area falls within the preset range, the display luminance value of the target display area does not change significantly. This improves a display effect of the display screen.

In addition, the luminance value of the target display area is defined by using a plurality of dimensions (e.g., first grayscale value, second grayscale value, and third grayscale value), so that precision of a definition of the luminance value is improved, and the luminance value displayed by the target display area does not change significantly. This improves the display effect of the display screen.

Figure 9:
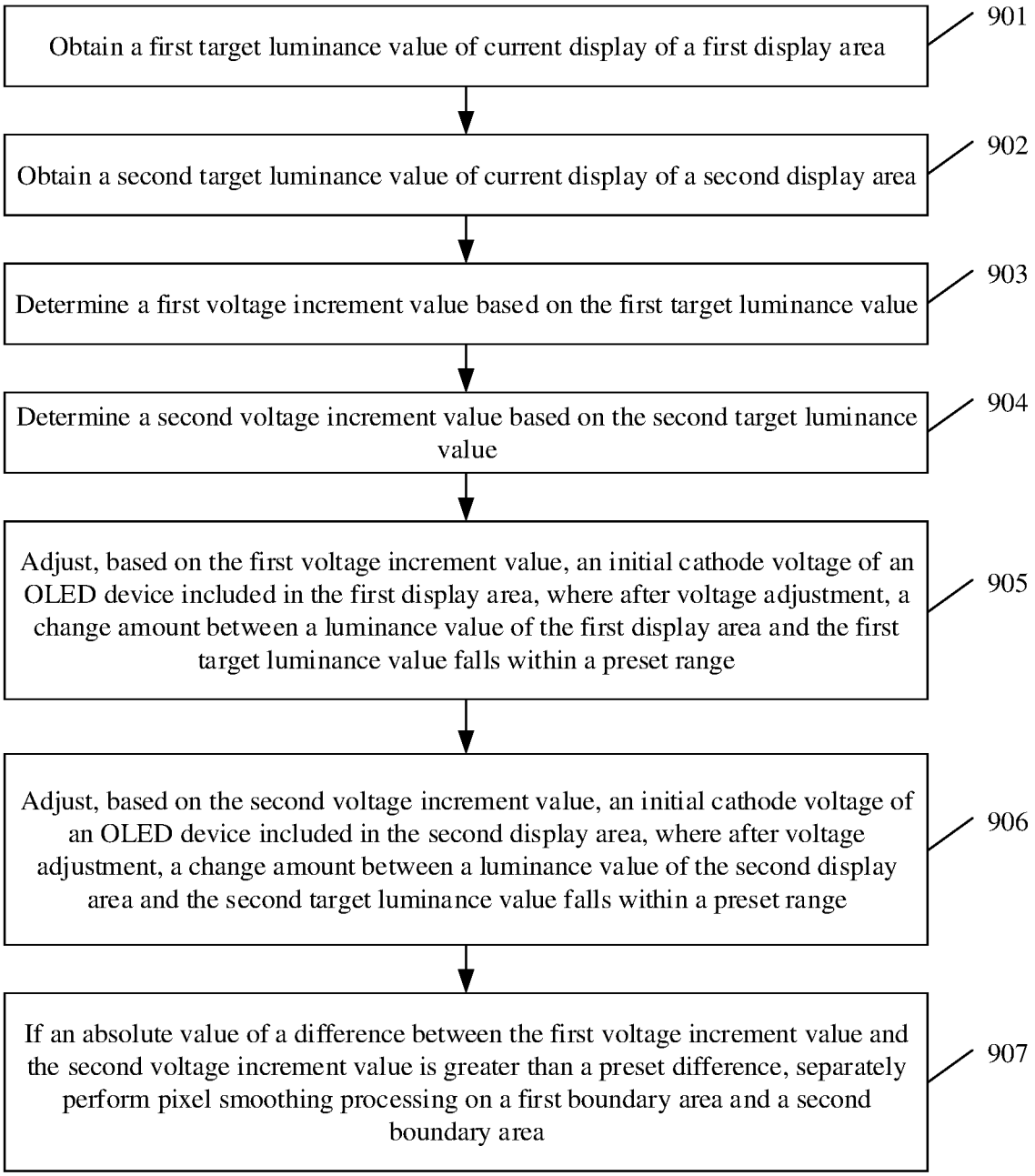
FIG. 9 is an example schematic flowchart of a voltage adjustment method according to an embodiment of this application.

FIG. 9 is a schematic flowchart of a voltage adjustment method according to an embodiment of this application. Specifically, the voltage adjustment method includes:

901. Obtain a first target luminance value of current display of a first display area.

The voltage adjustment method provided in this embodiment of this application may be applied to an electronic device. A display screen of the electronic device includes at least a first display area and a second display area, the first display area includes a first boundary area, the second display area includes a second boundary area, and the first boundary area is adjacent to the second boundary area.

In a scenario, the electronic device includes at least one display screen, and the display screen includes a plurality of target display areas. In another expression manner, the display screen includes a plurality of screen sub-blocks.

In this embodiment of this application, the display screen may include a plurality of target display areas, each target display area independently performs image display and backlight control, and a processor may obtain image information of the current target display area from a graphics processing unit. A display driver circuit can separately output information of different target display areas to corresponding sub-blocks of the display screen, and a power supply management circuit may separately regulate, based on instructions, a cathode voltage applied to an OLED device of a pixel circuit unit included in any target display area of the display screen.

Figure 5A:
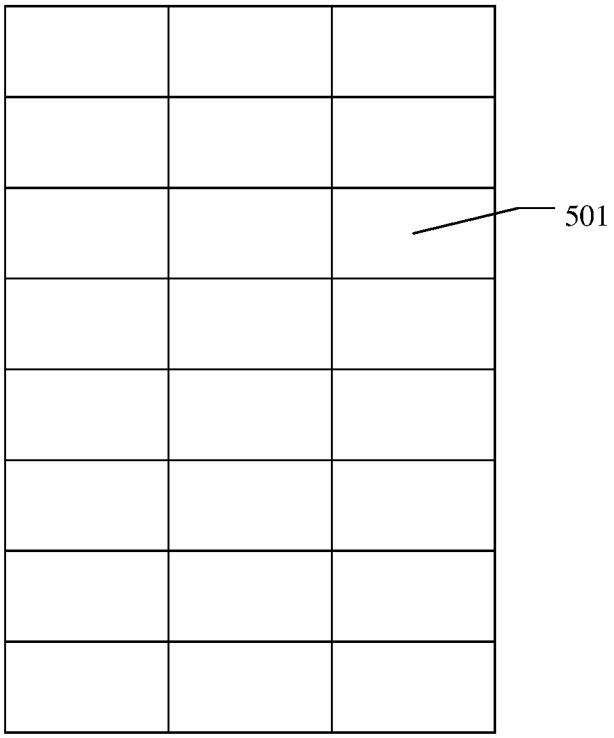
FIG. 5*a* is an example schematic diagram of a display screen of an electronic device according to this application.

FIG. 5*a* is a schematic diagram of a display screen of an electronic device according to this application. As shown in FIG. 5*a*, a display screen 500 may include a plurality of target display areas 501. In this embodiment, the processor may separately obtain a target luminance value of each target display area in the plurality of target display areas. For how the processor obtains the target luminance value of each target display area in the plurality of target display areas, refer to the foregoing description.

It should be noted that the target display area in FIG. 5*a* is merely an example, and does not constitute a limitation on this application.

In another scenario, the electronic device may include a plurality of display screens.

Figure 6A:
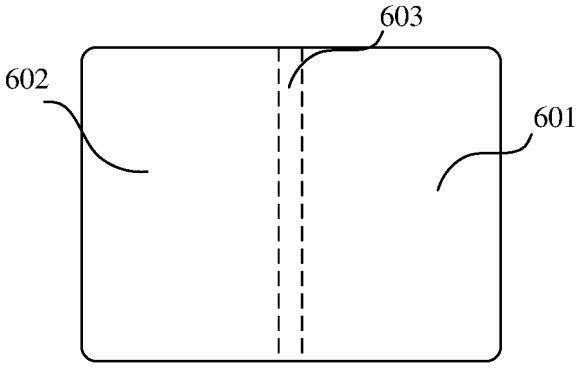
FIG. 6*a* is an example schematic diagram of a display screen of an electronic device according to this application.

FIG. 6*a* is a schematic diagram of a display screen of an electronic device according to this application.

As shown in FIG. 6*a*, the electronic device may include three display screens, respectively corresponding to three display areas, which are respectively a first area 601, a second area 602, and a third area 603. As shown in FIG. 6*a*, a middle bending part shown by dashed line boundaries of the display screen 600 is the third area 603. By using the third area 603 as a center, the display screen 600 may be divided into a left screen part and a right screen part, the right screen part is the first area 601, and the left screen part is the second area 602.

It should be noted that the display screen 600 shown in FIG. 6*a* is merely an example. In actual application, the electronic device may further include two or more than three display screens, and this is not limited herein.

In an embodiment, the electronic device includes a plurality of display screens, and each display screen in the plurality of display screens includes only one target display area.

Figure 6B:
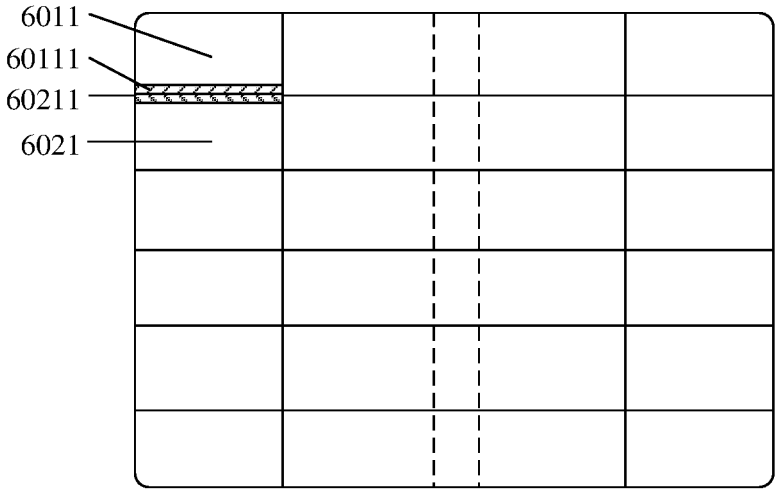
FIG. 6*b* is an example schematic diagram of a display screen of an electronic device according to this application.

In an embodiment, the electronic device includes a plurality of display screens, and each display screen in the plurality of display screens includes a plurality of target display areas. FIG. 6*b* is a schematic diagram of a display screen of an electronic device according to this application. As shown in FIG. 6*b*, the first area 601, the second area 602, and the third area 603 each include a plurality of target display areas. For example, the first area 601 may include a first display area 6011 and a second display area 6021.

In an embodiment, the electronic device includes a plurality of display screens, some of the plurality of display screens each include one target display area, and the other display screens each include a plurality of target display areas.

In this embodiment, the processor may obtain a target luminance value of each target display area in the plurality of target display areas.

Figure 5B:
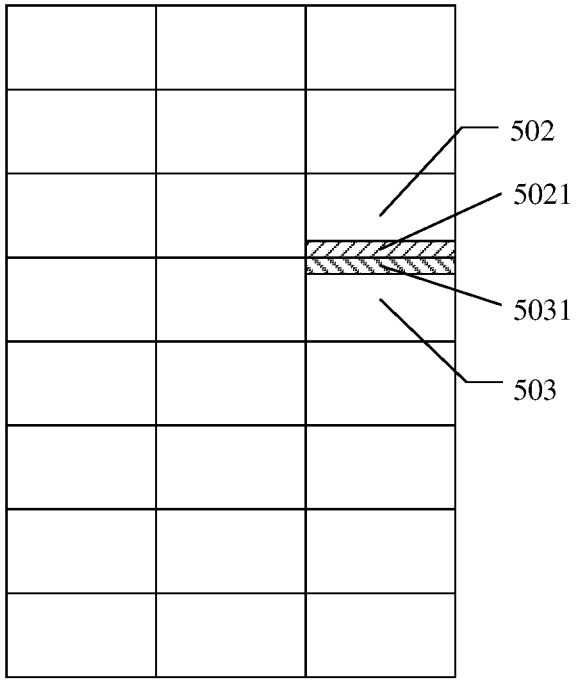
FIG. 5*b* is an example schematic diagram of a display screen of an electronic device according to this application.

In a scenario in this embodiment of this application, FIG. 5*b* is a schematic diagram of a display screen of an electronic device according to this application. As shown in FIG. 5*b*, a display screen 500 included in an electronic device includes a plurality of target display areas, and the target display area may include: a first display area 502 and a second display area 503. The first display area 502 includes a first boundary area 5021 and the second display area 503 includes a second boundary area 5031. The first boundary area 5021 is adjacent to the second boundary area 5031.

Figure 8:
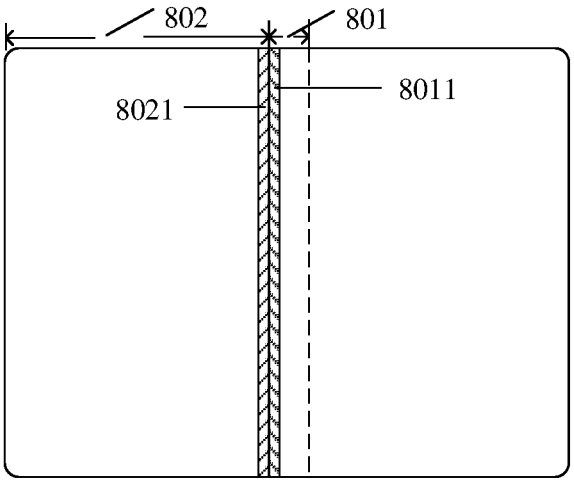
FIG. 8 is an example schematic diagram of a display screen of an electronic device according to this application.

In a scenario in this embodiment of this application, FIG. 8 is a schematic diagram of a display screen of an electronic device according to this application. As shown in FIG. 8, the electronic device includes a plurality of display screens, and each display screen in the plurality of display screens includes only one target display area. For example, the target display area may include a first display area 801 and a second display area 802. The first display area 801 includes a first boundary area 8011 and the second display area 802 includes a second boundary area 8021. The first boundary area 8011 is adjacent to the second boundary area 8021.

In a scenario in this embodiment of this application, as shown in FIG. 6*b*, the electronic device includes a plurality of display screens, and each display screen in the plurality of display screens includes a plurality of target display areas. For example, the target display area may include a first display area 6011 and a second display area 6021. The first display area 6011 includes a first boundary area 60111 and the second display area 6021 includes a second boundary area 60211. The first boundary area 60111 is adjacent to the second boundary area 60211.

It should be noted that, the first display area 502 and the second display area 503 shown in FIG. 5*b* are merely examples. In actual application, the display screen 500 may further include any two adjacent target display areas in a plurality of target display areas. The schematic diagram of FIG. 5*b* does not constitute a limitation on this application. Similarly, the first display area 801 and the second display area 802 shown in FIG. 8, and the first display area 6011 and the second display area 6021 shown in FIG. 6*b* are merely examples, and do not constitute a limitation on this application.

902. Obtain a second target luminance value of current display of the second display area.

In this embodiment of this application, for a specific manner in which the processor obtains the second target luminance value of current display of the second display area, refer to the specific manner in which the processor obtains the first target luminance value of current display of the first display area in step 901.

903. Determine a first voltage increment value based on the first target luminance value.

For a detailed description of step 903, refer to the description of step 302 in the embodiment corresponding to FIG. 3.

904. Determine a second voltage increment value based on the second target luminance value.

For a specific description of step 904, refer to the specific description of step 302 in the embodiment corresponding to FIG. 3.

905. Adjust, based on the first voltage increment value, an initial cathode voltage of an OLED device included in the first display area, where after voltage adjustment, a change amount between a luminance value of the first display area and the first target luminance value falls within a preset range.

For how to adjust, based on the first voltage increment value, the initial cathode voltage of the OLED device included in the first display area, refer to the specific description of step 303 in the embodiment corresponding to FIG. 3.

906. Adjust, based on the second voltage increment value, an initial cathode voltage of an OLED device included in the second display area, where after voltage adjustment, a change amount between a luminance value of the second display area and the second target luminance value falls within a preset range.

907. If an absolute value of a difference between the first voltage increment value and the second voltage increment value is greater than a preset difference, separately perform pixel smoothing processing on the first boundary area and the second boundary area.

In this embodiment of this application, if the absolute value of the difference between the first voltage increment value and the second voltage increment value is greater than the preset difference, an excessively large display luminance difference may occur in adjacent boundary areas of the first display area and the second display area.

Based on this, if the absolute value of the difference between the voltage increment value corresponding to the first display area (e.g., the first voltage increment value) and the voltage increment value corresponding to the second display area (e.g., the second voltage increment value) is greater than the preset difference, the processor separately performs smoothing processing on the first boundary area and the second boundary area.

In an embodiment, the preset difference may be any value less than or equal to 10, or the preset difference may be a value correlated with the first voltage increment value or the second voltage increment value.

For example, the preset difference may be 5% of the first voltage increment value.

For example, the preset difference may be 5% of the second voltage increment value.

In an embodiment, different pixel smoothing processing policies may be used for different absolute values of the difference between the voltage increment value corresponding to the first display area and the voltage increment value corresponding to the second display area.

For example, if the absolute value of the difference between the first voltage increment value and the second voltage increment value is greater than a first preset difference, 5*5 pixel smoothing processing is separately performed on the first boundary area and the second boundary area. If the absolute value of the difference between the first voltage increment value and the second voltage increment value is greater than a second preset difference, 3*3 pixel smoothing processing is separately performed on the first boundary area and the second boundary area.

For example, the first preset difference may be 5% of the first voltage increment value, and the second preset difference may be 3% of the first voltage increment value.

For example, the first preset difference may be 5% of the second voltage increment value, and the second preset difference may be 3% of the second voltage increment value.

For example, the first preset difference may be 10, and the second preset difference may be 5.

It should be noted that the foregoing is merely an example, and does not constitute a limitation on this application.

In this embodiment of this application, after determining the voltage increment value corresponding to the target luminance value, the processor may send digital information carrying the voltage increment value to a display driver circuit DDIC, and the DDIC may perform digital-to-analog conversion on the digital information received from the processor. After it is determined that the absolute value of the difference between the first voltage increment value and the second voltage increment value is greater than the preset difference, pixel smoothing processing is separately performed on the first boundary area and the second boundary area.

It should be noted that the pixel smoothing processing may be mean filtering, low-pass filtering, or the like, which is not limited herein.

This embodiment of this application provides a voltage adjustment method, including: obtaining a first target luminance value of current display of a first display area; obtaining a second target luminance value of current display of a second display area; determining a first voltage increment value based on the first target luminance value; determining a second voltage increment value based on the second target luminance value; adjusting, based on the first voltage increment value, an initial cathode voltage of an OLED device included in the first display area, where after voltage adjustment, a change amount between a luminance value of the first display area and the first target luminance value falls within a preset range; adjusting, based on the second voltage increment value, an initial cathode voltage of an OLED device included in the second display area, where after voltage adjustment, a change amount between a luminance value of the second display area and the second target luminance value falls within a preset range; and if an absolute value of a difference between the first voltage increment value and the second voltage increment value is greater than a preset difference, separately performing pixel smoothing processing on a first boundary area and a second boundary area. In the foregoing manner, when cathode voltage adjustment is performed on OLED devices included in a plurality of target display areas, display quality degradation caused by excessively large voltage adjustment amplitude differences between adjacent areas can be avoided.

Refer to FIG. 2*a*. This application provides an electronic device, including: one or more processors 210, configured to obtain a target luminance value of current display of a display pixel; and determine a voltage increment value based on the target luminance value; and a power supply management circuit 250, configured to adjust, based on the voltage increment value, an initial cathode voltage of an OLED device corresponding to the display pixel, where after voltage adjustment, a change amount between a luminance value of the display pixel and the target luminance value falls within a preset range.

In an embodiment, the processor 210 may send digital information carrying the voltage increment value to a display driver circuit 240 in FIG. 2*a*, which may send the digital information to the power supply management circuit 250, which may perform digital-to-analog conversion on the received digital information, send an analog signal to hardware in a display screen 260 for validation, and adjust an initial cathode voltage of an OLED device included in a target display area displayed in the display screen 260.

It should be noted that, the display driver circuit 240 may process the voltage increment value carried in the digital information received from the processor 210, for example, multiplying the voltage increment value by a preset multiple, and then send the digital information carrying the processed voltage increment value to the power supply management circuit 250.

Optionally, the processor 210 is configured to:

determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

Optionally, the processor 210 is configured to:

determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

Optionally, the preset range is less than or equal to 5% of the target luminance value.

This application further provides an electronic device, including: one or more processors 210, configured to obtain a target luminance value of current display of a target display area; and determine a voltage increment value based on the target luminance value; and a power supply management circuit 250, configured to adjust, based on the voltage increment value, an initial cathode voltage of an OLED device included in the target display area, where after voltage adjustment, a change amount between a luminance value of the target display area and the target luminance value falls within a preset range.

Optionally, the processor 210 is configured to:

determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

Optionally, the processor 210 is configured to:

determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

Optionally, the preset range is less than or equal to 5% of the target luminance value.

Optionally, the processor 210 is configured to: obtain at least one grayscale value of current display of the target display area, where the at least one grayscale value includes: a first grayscale value, a second grayscale value, or a third grayscale value; where the first grayscale value is used to represent an average grayscale value of a plurality of display pixels included in the target display area; in the target display area, a quantity of display pixels with grayscale values greater than or equal to the second grayscale value is greater than or equal to a preset quantity, and a quantity of display pixels with grayscale values greater than or equal to a fourth grayscale value is less than the first preset value, and the fourth grayscale value is any grayscale value greater than the second grayscale value; and the third grayscale value corresponds to saturation and hue of the target display area; and determine a weighted average value of the at least one grayscale value as a target luminance value of current display of the target display area.

Optionally, the target display area includes a plurality of display pixels. Each display pixel in the plurality of display pixels corresponds to one RGB vector. The RGB vector includes an R value, a G value, and a B value.

The processor 210 is configured to: obtain a plurality of first sub-grayscale values of current display of the target display area, where each display pixel in the plurality of display pixels corresponds to one first sub-grayscale value, and the first sub-grayscale value is a weighted average value of a corresponding R value, G value, and B value; and determine a weighted average value of the plurality of first sub-grayscale values as the first grayscale value.

Optionally, the target display area includes a plurality of display pixels. Each display pixel in the plurality of display pixels corresponds to one RGB vector. The RGB vector includes an R value, a G value, and a B value.

The processor 210 is configured to: obtain a plurality of second sub-grayscale values of current display of the target display area, where each display pixel in the plurality of display pixels corresponds to one second sub-grayscale value, and the second sub-grayscale value is a maximum value of a corresponding R value, G value, and B value, the second sub-grayscale value is the corresponding R value, the second sub-grayscale value is the corresponding G value, the second sub-grayscale value is the corresponding B value, the second sub-grayscale value is a larger one of the corresponding R value and G value, the second sub-grayscale value is a larger one of the corresponding R value and B value, or the second sub-grayscale value is a larger one of the corresponding G value and B value; and determine, based on the plurality of second sub-grayscale values, the second grayscale value of current display of the target display area, where a quantity of second sub-grayscale values greater than or equal to the second grayscale value in the plurality of second sub-grayscale values is greater than or equal to a preset quantity, a quantity of second sub-grayscale values greater than or equal to a fourth grayscale value in the plurality of second sub-grayscale values is less than the preset quantity, and the fourth grayscale value is any grayscale value greater than the second grayscale value.

Optionally, the target display area includes a plurality of display pixels, and each display pixel in the plurality of display pixels corresponds to one saturation value and one hue value.

The processor 210 is configured to: obtain a plurality of saturation values and a plurality of hue values of current display of the target display area; determine an average value of the plurality of saturation values as a target saturation average value; determine an average value of the plurality of hue values as a target hue average value; and determine, based on a third preset relationship, a third grayscale value corresponding to the target saturation average value and the target hue average value, where the third preset relationship includes a correspondence among a plurality of saturation average values, a plurality of hue average values, and a plurality of third grayscale values, the target saturation average value is one of the plurality of saturation average values, and the target hue average value is one of the plurality of hue average values.

This application further provides an electronic device, including: a display screen, where the display screen includes at least a first display area and a second display area, the first display area includes a first boundary area, the second display area includes a second boundary area, and the first boundary area is adjacent to the second boundary area; one or more processors 210, configured to: obtain a first target luminance value of current display of the first display area, obtain a second target luminance value of current display of the second display area, determine a first voltage increment value based on the first target luminance value, and determine a second voltage increment value based on the second target luminance value; a power supply management circuit 250, configured to adjust, based on the first voltage increment value, an initial cathode voltage of an OLED device included in the first display area, where after voltage adjustment, a change amount between a luminance value of the first display area and the first target luminance value falls within a preset range, and adjust, based on a second voltage increment value, an initial cathode voltage of an OLED device included in the second display area, where after voltage adjustment, a change amount between a luminance value of the second display area and the second target luminance value falls within a preset range; and a display driver circuit 240, configured to: if an absolute value of a difference between the first voltage increment value and the second voltage increment value is greater than a preset difference, separately perform pixel smoothing processing on the first boundary area and the second boundary area.

Optionally, the processor 210 is configured to: determine, based on a first preset relationship, the first voltage increment value corresponding to the first target luminance value; and determine, based on the first preset relationship, the second voltage increment value corresponding to the second target luminance value; where the first preset relationship includes a correspondence between a plurality of luminance values and a plurality of voltage increment values, where the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values; or determine, based on a second preset relationship, the first voltage increment value corresponding to the first target luminance value; and determine, based on the second preset relationship, the second voltage increment value corresponding to the second target luminance value; where the second preset relationship includes a correspondence between a plurality of luminance values and a plurality of voltage increment values, where a voltage value in the plurality of voltage increment values decreases as the luminance value increases, the first target luminance value is one of the plurality of luminance values, and the second target luminance value is one of the plurality of voltage increment values.

Optionally, the preset range is less than or equal to 5% of the target luminance value.

Figure 10:
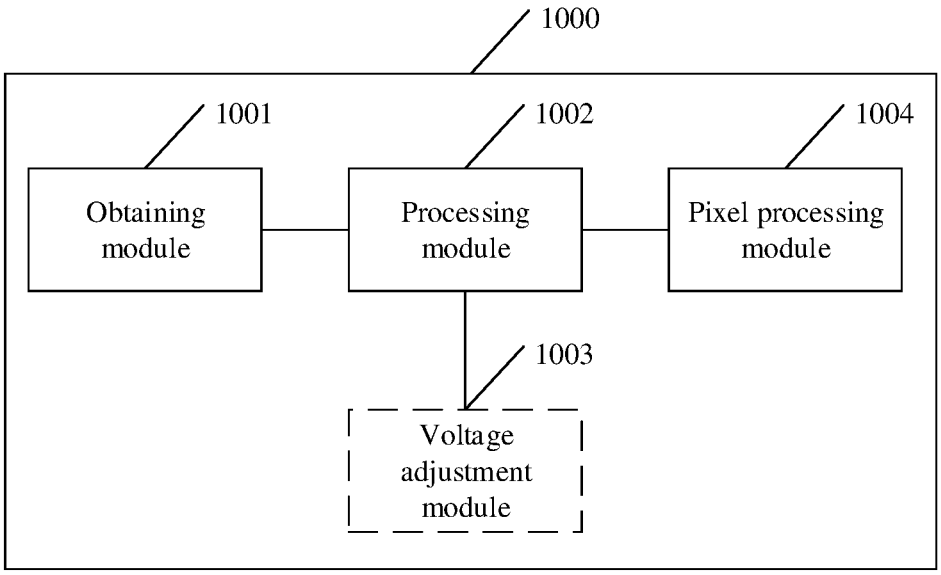
FIG. 10 is an example schematic diagram of a structure of a voltage adjustment device according to this application.

FIG. 10 is a schematic diagram of a structure of a voltage adjustment device according to this application. As shown in FIG. 10, a voltage adjustment device 1000 includes: an obtaining module 1001, configured to obtain a target luminance value of current display of a display pixel; a processing module 1002, configured to determine a voltage increment value based on the target luminance value; and a voltage adjustment module 1003, configured to adjust, based on the voltage increment value, an initial cathode voltage of an OLED device corresponding to the display pixel, where after voltage adjustment, a change amount between a luminance value of the display pixel and the target luminance value falls within a preset range.

Optionally, the processing module 1002 is configured to determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

Optionally, the processing module 1002 is configured to determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

Optionally, the preset range is less than or equal to 5% of the target luminance value.

This application further provides a voltage adjustment apparatus, including: an obtaining module 1001, configured to obtain a target luminance value of current display of a target display area; a processing module 1002, configured to determine a voltage increment value based on the target luminance value; and a voltage adjustment module 1003, configured to adjust, based on the voltage increment value, an initial cathode voltage of an OLED device included in the target display area, where after voltage adjustment, a change amount between a luminance value of the target display area and the target luminance value falls within a preset range.

Optionally, the processing module 1002 is configured to determine, based on a first preset relationship, the voltage increment value corresponding to the target luminance value, where the first preset relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the target luminance value is one of the plurality of luminance values, and the voltage increment value corresponding to the target luminance value is one of the plurality of voltage increment values.

Optionally, the processing module 1002 is configured to determine, based on a second preset relationship, the voltage increment value corresponding to the target luminance value, where the second preset relationship includes a correspondence between a plurality of luminance values and a plurality of voltage increment values, a voltage value in the plurality of voltage increment values decreases as the luminance value increases, the target luminance value is one of the plurality of luminance values, and the voltage increment value corresponding to the target luminance value is one of the plurality of voltage increment values.

Optionally, the preset range is less than or equal to 5% of the target luminance value.

Optionally, the processing module 1002 is configured to obtain at least one grayscale value of current display of the target display area, where the at least one grayscale value includes: a first grayscale value, a second grayscale value, or a third grayscale value; where the first grayscale value is used to represent an average grayscale value of a plurality of display pixels included in the target display area; in the target display area, a quantity of display pixels with grayscale values greater than or equal to the second grayscale value is greater than or equal to a preset quantity, and a quantity of display pixels with grayscale values greater than or equal to a fourth grayscale value is less than the first preset value, and the fourth grayscale value is any grayscale value greater than the second grayscale value; and the third grayscale value corresponds to saturation and hue of the target display area; and determine a weighted average value of the at least one grayscale value as a target luminance value of current display of the target display area.

Optionally, the target display area includes a plurality of display pixels. Each display pixel in the plurality of display pixels corresponds to one RGB vector. The RGB vector includes an R value, a G value, and a B value.

Optionally, the processing module 1002 is configured to obtain a plurality of first sub-grayscale values of current display of the target display area, where each display pixel in the plurality of display pixels corresponds to one first sub-grayscale value. The first sub-grayscale value is a weighted average value of a corresponding R value, G value, and B value; and determine a weighted average value of the plurality of first sub-grayscale values as the first grayscale value.

Optionally, the target display area includes a plurality of display pixels. Each display pixel in the plurality of display pixels corresponds to one RGB vector. The RGB vector includes an R value, a G value, and a B value.

Optionally, the processing module 1002 is configured to obtain a plurality of second sub-grayscale values of current display of the target display area, where each display pixel in the plurality of display pixels corresponds to one second sub-grayscale value, and the second sub-grayscale value is a maximum value of a corresponding R value, G value, and B value, the second sub-grayscale value is the corresponding R value, the second sub-grayscale value is the corresponding G value, the second sub-grayscale value is the corresponding B value, the second sub-grayscale value is a larger one of the corresponding R value and G value, the second sub-grayscale value is a larger one of the corresponding R value and B value, or the second sub-grayscale value is a larger one of the corresponding G value and B value; and determine, based on the plurality of second sub-grayscale values, the second grayscale value of current display of the target display area, where a quantity of second sub-grayscale values greater than or equal to the second grayscale value in the plurality of second sub-grayscale values is greater than or equal to a preset quantity, a quantity of second sub-grayscale values greater than or equal to a fourth grayscale value in the plurality of second sub-grayscale values is less than the preset quantity, and the fourth grayscale value is any grayscale value greater than the second grayscale value.

Optionally, the target display area includes a plurality of display pixels, and each display pixel in the plurality of display pixels corresponds to one saturation value and one hue value.

Optionally, the processing module 1002 is configured to obtain a plurality of saturation values and a plurality of hue values of current display of the target display area; determine an average value of the plurality of saturation values as a target saturation average value; determine an average value of the plurality of hue values as a target hue average value; and determine, based on a third preset relationship, a third grayscale value corresponding to the target saturation average value and the target hue average value, where the third preset relationship includes a correspondence among a plurality of saturation average values, a plurality of hue average values, and a plurality of third grayscale values, the target saturation average value is one of the plurality of saturation average values, and the target hue average value is one of the plurality of hue average values.

This application further provides a voltage adjustment apparatus, including: a display screen of the voltage adjustment apparatus, where the display screen includes at least a first display area and a second display area, the first display area includes a first boundary area, the second display area includes a second boundary area, the first boundary area is adjacent to the second boundary area, and the voltage adjustment apparatus further includes: an obtaining module 1001, configured to obtain a first target luminance value of current display of the first display area and obtain a second target luminance value of current display of the second display area; a processing module 1002, configured to determine a first voltage increment value based on the first target luminance value and determine a second voltage increment value based on the second target luminance value; a voltage adjustment module 1003, configured to adjust, based on the first voltage increment value, an initial cathode voltage of an OLED device included in the first display area, where after voltage adjustment, a change amount between a luminance value of the first display area and the first target luminance value falls within a preset range; and a display driver module 1004 (also referred to as pixel processing module 1004), configured to: if an absolute value of a difference between the first voltage increment value and the second voltage increment value is greater than a preset difference, separately perform pixel smoothing processing on the first boundary area and the second boundary area.

Optionally, the processing module 1002 is configured to determine, based on a first preset relationship, the first voltage increment value corresponding to the first target luminance value; and determine, based on the first preset relationship, the second voltage increment value corresponding to the second target luminance value.

The first preset relationship includes a correspondence between a plurality of luminance values and a plurality of voltage increment values, where the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values.

Optionally, the processing module 1002 is configured to determine, based on a second preset relationship, the first voltage increment value corresponding to the first target luminance value; and determine, based on the second preset relationship, the second voltage increment value corresponding to the second target luminance value; where the second preset relationship includes a correspondence between a plurality of luminance values and a plurality of voltage increment values, where a voltage value in the plurality of voltage increment values decreases as the luminance value increases, the first target luminance value is one of the plurality of luminance values, and the second target luminance value is one of the plurality of voltage increment values.

Optionally, the preset range is less than or equal to 5% of the target luminance value.

In one or more examples, the described functions may be implemented by hardware, software, firmware, or any combination thereof. If the functions are implemented by software, the functions may be stored as one or more instructions or code in a computer-readable medium or sent by a computer-readable medium, and are executed by a hardware-based processing unit. The computer-readable medium may include a computer-readable storage medium (which is corresponding to a tangible medium such as a data storage medium) or a communications medium. The communications medium includes (for example) any medium that facilitates, according to a communications protocol, transmission of a computer program from one location to another location. In this way, the computer-readable medium may be substantially corresponding to: (1) a non-transitory tangible computer-readable storage medium, or (2) a communications medium such as a signal or a carrier. The data storage medium may be any available medium that can be accessed by one or more computers or one or more processors to retrieve an instruction, code, and/or a data structure for implementing a technology described in the present disclosure. A computer program product may include the computer-readable medium.

By way of an example and not limitation, some computer-readable storage media may include a RAM, a ROM, an EEPROM, a CD-ROM or another optical disc storage, a magnetic disk storage or another magnetic storage apparatus, a flash memory, or any other medium that can store required program code in a form of an instruction or a data structure and that can be accessed by a computer.

Instructions may be executed by one or more processors such as one or more digital signal processors (DSPs), one or more general microprocessors, one or more application-specific integrated circuits (ASICs), one or more field programmable gate arrays (FPGAs), or one or more other equivalent integrated circuits or discrete logic circuits. Therefore, the term "processor" used in this specification may represent any one of the foregoing structures or another structure that is applicable to implementing the technologies described in this specification.

It should be understood that "one embodiment" or "an embodiment" mentioned throughout the specification means that particular features, structures, or characteristics related to the embodiment are included in at least one embodiment of the present technology. Therefore, "in one embodiment" or "in an embodiment" that appears throughout the entire specification does not necessarily mean a same embodiment. In addition, these particular features, structures, or characteristics may be combined in any appropriate manner in one or more embodiments.

It should be understood that sequence numbers of the foregoing processes do not mean an execution sequence in the embodiments of the present technology. The execution sequence of the processes should be determined based on functions and internal logic of the processes, and should not be construed as any limitation on the implementation processes of the embodiments of the present technology.

It should be understood that in the embodiments of this application, "B corresponding to A" indicates that B is associated with A, and B may be determined based on A. However, it should further be understood that determining A according to B does not mean that B is determined according only to A; that is, B may also be determined according to A and/or other information.

A person of ordinary skill in the art may be aware that, in combination with the examples described in the embodiments disclosed in this specification, units and algorithm steps may be implemented by electronic hardware, computer software, or a combination thereof. To clearly describe the interchangeability between the hardware and the software, the foregoing has generally described compositions and steps of the examples according to functions. Whether the functions are performed by hardware or software depends on particular applications and implementation constraints of the technical solutions. A person skilled in the art may use different methods to implement the described functions for the particular applications, but it should not be considered that the implementation falls beyond the scope of the present technology.

It may be clearly understood by a person skilled in the art that, for ease and brevity of description, for a detailed working process of the foregoing system, apparatus, and unit, refer to a corresponding process in the foregoing method embodiments.

In the several embodiments provided in this application, it should be understood that the disclosed system, apparatus, and method may be implemented in other manners. For example, the described apparatus embodiment is merely an example. For example, division into the units is merely logical function division and may be other division in actual implementation. For example, a plurality of units or components may be combined or integrated into another system, or some features may be ignored or not performed.

In addition, functional units in the embodiments of this application may be integrated into one processing unit, or each of the units may exist alone physically, or two or more units may be integrated into one unit.

What is claimed is:

1. A voltage adjustment method, comprising:

obtaining a target luminance value of a current display of a target display area;

determining, based on a first relationship, a voltage increment value corresponding to the target luminance value, wherein the first relationship includes a correspondence between a plurality of luminance values and a plurality of voltage increment values, the target luminance value is one of the plurality of luminance values, and the voltage increment value corresponding to the target luminance value is one of the plurality of voltage increment values; and adjusting, based on the voltage increment value, an initial cathode voltage of an organic light-emitting diode (OLED) device included in the target display area, wherein after voltage adjustment, a change amount between a luminance value of the target display area and the target luminance value falls within a specified range, and a voltage value in the plurality of voltage increment values decreases as the luminance value increases.

2. The method according to claim 1, wherein the plurality of luminance values include a first luminance value and a second luminance value, the first luminance value belongs to a first luminance value range [a, b], the second luminance value belongs to a second luminance value range [c, d], b is less than c, and a voltage increment value corresponding to the first luminance value is greater than a voltage increment value corresponding to the second luminance value.

3. The method according to claim 1, wherein the specified range is less than or equal to 5% of the target luminance value.

4. A non-transitory computer readable storage medium comprising computer readable instructions, wherein the computer readable instructions, when run on an electronic device, cause the electronic device to perform the voltage adjustment method according to claim 1.

5. The method according to claim 1, wherein a mapping table is stored in a memory, the mapping table includes the correspondence between the plurality of luminance values and the plurality of voltage increment values, and the voltage increment value is determined using the mapping table.

6. A voltage adjustment method applied to an electronic device, wherein a display screen of the electronic device includes at least a first display area and a second display area, the first display area includes a first boundary area, the second display area includes a second boundary area, and the first boundary area is adjacent to the second boundary area, wherein the method comprising:

obtaining a first target luminance value of a current display of the first display area;

obtaining a second target luminance value of the current display of the second display area;

determining a first voltage increment value based on the first target luminance value;

determining a second voltage increment value based on the second target luminance value;

adjusting, based on the first voltage increment value, an initial cathode voltage of an organic light-emitting diode (OLED) device included in the first display area, wherein after voltage adjustment, a change amount between a luminance value of the first display area and the first target luminance value falls within a specified range;

adjusting, based on the second voltage increment value, an initial cathode voltage of an OLED device included in the second display area, wherein after voltage adjustment, a change amount between a luminance value of the second display area and the second target luminance value falls within the specified range; and if an absolute value of a difference between the first voltage increment value and the second voltage increment value is greater than a specified difference, separately performing pixel smoothing processing on the first boundary area and the second boundary area.

7. The method according to claim 6, wherein determining the first voltage increment value and determining the second voltage increment value comprise:

determining, based on a first relationship, the first voltage increment value corresponding to the first target luminance value; and determining, based on the first relationship, the second voltage increment value corresponding to the second target luminance value, wherein the first relationship includes a correspondence between a plurality of luminance values and a plurality of voltage increment values, the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values.

8. The method according to claim 6, wherein determining the first voltage increment value and determining the second voltage increment value comprise:

determining, based on a second relationship, the first voltage increment value corresponding to the first target luminance value; and determining, based on the second relationship, the second voltage increment value corresponding to the second target luminance value, wherein the second relationship includes a correspondence between a plurality of luminance values and a plurality of voltage increment values, a voltage value in the plurality of voltage increment values decreases as the luminance value increases, the first target luminance value is one of the plurality of luminance values, and the second target luminance value is one of the plurality of voltage increment values.

9. The method according to claim 6, wherein the specified range is less than or equal to 5% of the first or second target luminance value.

10. A non-transitory computer readable storage medium comprising computer readable instructions, wherein the computer readable instructions, when run on an electronic device, cause the electronic device to perform the voltage adjustment method according to claim 6.

11. An electronic device, comprising:

one or more processors configured to obtain a target luminance value of a current display of a target display area, and determine, based on a first relationship, a voltage increment value corresponding to the target luminance value, wherein the first relationship includes a correspondence between a plurality of luminance values and a plurality of voltage increment values, the target luminance value is one of the plurality of luminance values, and the voltage increment value corresponding to the target luminance value is one of the plurality of voltage increment values; and a power supply management circuit configured to adjust, based on the voltage increment value, an initial cathode voltage of an organic light-emitting diode (OLED) device included in the target display area, wherein after voltage adjustment, a change amount between a luminance value of the target display area and the target luminance value falls within a specified range, and a voltage value in the plurality of voltage increment values decreases as the luminance value increases.

12. The electronic device according to claim 11, wherein the specified range is less than or equal to 5% of the target luminance value.

13. The electronic device according to claim 11, wherein the plurality of luminance values include a first luminance value and a second luminance value, the first luminance value belongs to a first luminance value range [a, b], the second luminance value belongs to a second luminance value range [c, d], b is less than c, and a voltage increment value corresponding to the first luminance value is greater than a voltage increment value corresponding to the second luminance value.

14. The electronic device according to claim 11, wherein a mapping table is stored in a memory, the mapping table includes the correspondence between the plurality of luminance values and the plurality of voltage increment values, and the voltage increment value is determined using the mapping table.

15. An electronic device, comprising:

a display screen, wherein the display screen includes at least a first display area and a second display area, the first display area includes a first boundary area, the second display area includes a second boundary area, and the first boundary area is adjacent to the second boundary area;

one or more processors configured to:

obtain a first target luminance value of a current display of the first display area, obtain a second target luminance value of a current display of the second display area, determine a first voltage increment value based on the first target luminance value, and determine a second voltage increment value based on the second target luminance value;

a power supply management circuit configured to adjust, based on the first voltage increment value, an initial cathode voltage of an OLED device included in the first display area, wherein after voltage adjustment, a change amount between a luminance value of the first display area and the first target luminance value falls within a specified range; and a display driver circuit configured to: if an absolute value of a difference between the first voltage increment value and the second voltage increment value is greater than a specified difference, separately perform pixel smoothing processing on the first boundary area and the second boundary area.

16. The electronic device according to claim 15, wherein the one or more processors are configured to:

determine, based on a first relationship, the first voltage increment value corresponding to the first target luminance value; and determine, based on the first relationship, the second voltage increment value corresponding to the second target luminance value, wherein the first relationship includes a correspondence between a plurality of luminance values and a plurality of voltage increment values, wherein the plurality of luminance values include a first luminance value and a second luminance value, the first luminance value belongs to a first luminance value range [a, b], the second luminance value belongs to a second luminance value range [c, d], b is less than c, a voltage increment value corresponding to the first luminance value is greater than a voltage increment value corresponding to the second luminance value, the first target luminance value is one of the plurality of luminance values, the second target luminance value is one of the plurality of luminance values, the first voltage increment value is one of the plurality of voltage increment values, and the second voltage increment value is one of the plurality of voltage increment values; or determine, based on a second relationship, the first voltage increment value corresponding to the first target luminance value; and determine, based on the second relationship, the second voltage increment value corresponding to the second target luminance value, wherein the second relationship includes the correspondence between the plurality of luminance values and the plurality of voltage increment values, wherein a voltage value in the plurality of voltage increment values decreases as the luminance value increases, the first target luminance value is one of the plurality of luminance values, and the second target luminance value is one of the plurality of voltage increment values.

17. The electronic device according to claim 15, wherein the specified range is less than or equal to 5% of the target luminance value.

* * * * *